US009731512B2

(12) United States Patent
Ueda et al.

(10) Patent No.: US 9,731,512 B2
(45) Date of Patent: Aug. 15, 2017

(54) LIQUID SUPPLY SYSTEM AND INKJET RECORDING DEVICE INCLUDING THE SAME

(71) Applicant: Roland DG Corporation, Hamamatsu-shi, Shizuoka (JP)

(72) Inventors: Naoki Ueda, Hamamatsu (JP); Kazuya Morizono, Hamamatsu (JP); Yoshitaka Hatano, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/393,302

(22) Filed: Dec. 29, 2016

(65) Prior Publication Data

US 2017/0106661 A1 Apr. 20, 2017

Related U.S. Application Data

(63) Continuation of application No. 15/248,187, filed on Aug. 26, 2016.

(30) Foreign Application Priority Data

Aug. 28, 2015 (JP) ..... 2015-169126

(51) Int. Cl.
*B41J 2/175* (2006.01)

(52) U.S. Cl.
CPC ..... *B41J 2/17596* (2013.01); *B41J 2/17566* (2013.01)

(58) Field of Classification Search
CPC ..... B41J 2/17566; B41J 2/17596
See application file for complete search history.

(56) References Cited

U.S. PATENT DOCUMENTS

2010/0214332 A1* 8/2010 Iwase ..... B41J 2/175 347/7

OTHER PUBLICATIONS

Ueda et al., "Liquid Supply System and Inkjet Recording Device Including the Same", U.S. Appl. No. 15/248,187, filed Aug. 26, 2016.

* cited by examiner

*Primary Examiner* — Juanita D Jackson
(74) *Attorney, Agent, or Firm* — Keating & Bennett, LLP

(57) ABSTRACT

A liquid supply system includes a liquid supply source, an injection head, a damper in communication with the injection head, a liquid supply path including an end in communication with the liquid supply source and another end in communication with the damper, a liquid supply device supplying the liquid from the liquid supply source toward the damper, a pressure control valve provided between the liquid supply source and the liquid supply device, and a controller controlling the liquid supply device to be actuated or to be stopped. The pressure control valve closes the liquid supply path while the liquid supply device stopped.

11 Claims, 12 Drawing Sheets

LIQUID SUPPLY SYSTEM AND INKJET RECORDING DEVICE INCLUDING THE SAME

CROSS REFERENCE TO RELATED APPLICATIONS

The present application claims priority to Japanese Patent Application No. 2015-169126 filed on Aug. 28, 2015, which is incorporated by reference herein in its entirety.

BACKGROUND OF THE INVENTION

1. Field of the Invention

The present invention relates to a liquid supply system supplying a liquid from a liquid supply source to an injection head, and an inkjet recording device including the same.

2. Description of the Related Art

Recently, relatively large printed items such as signboards, posters and the like are often printed by an inkjet recording device. Such a recording device consumes a larger amount of ink than a printer for home use, and therefore, adopts a structure in which a large capacity ink cartridge is located away from a carriage having an ink head mounted thereon, namely, an off-carriage system. In the case of a recording device of the off-carriage system, an ink supply path (preferably, flexible tube) between the ink cartridge and the ink head becomes longer as the recording device increases in size. This increases the pressure fluctuation in the ink supply path. As a result, ink is not supplied to the ink head stably, which may decrease the printing quality.

In such a situation, for example, Japanese Laid-Open Patent Publication No. 2010-194915 discloses an inkjet printer including a damper and a tube pump located on an ink supply path. With this structure, the pressure fluctuation is alleviated by the damper and thus the ink is supplied to the ink head stably.

In a recording device of the off-carriage system, the ink cartridge may be located at a position higher than that of the ink head. In this case, the hydraulic head of the ink cartridge is higher than that of the ink head. This causes an undesirable possibility that the ink may leak from the ink head while printing is not performed. With the structure described in Patent Japanese Laid-Open Patent Publication No. 2010-194915, the tube pump is at a stop while the printing is not performed. Therefore, it is considered that the ink supply path (tube) in the tube pump is pressed to be closed, and thus the ink is prevented from leaking from the ink head.

However, with the above-described structure, in the case where, for example, the printer is not used for a long time, the tube is kept on pressed at the same position, namely, such a position of the tube is kept crushed. In this case, the tube may be softened at this position and the elasticity thereof may be decreased. As a result, the ink flow path may be occluded or broken, and thus it may become difficult to supply the ink stably for the printing.

SUMMARY OF THE INVENTION

Preferred embodiments of the present invention provide liquid supply systems that allow a liquid to be supplied stably to an injection head while being used and prevent the liquid from leaking from the injection head properly while not being used. Other preferred embodiments of the present invention provide inkjet recording devices including the above-described liquid supply systems.

A liquid supply system according to a preferred embodiment of the present invention includes a liquid supply source storing a liquid; an injection head including a nozzle through which the liquid is injected; a damper that is in communication with the injection head and includes a storage chamber temporarily storing the liquid; a liquid supply path including an end in communication with the liquid supply source and another end in communication with the damper; a liquid supply device that is provided on the liquid supply path and supplies the liquid from the liquid supply source toward the damper; a pressure control valve provided on a portion of the liquid supply path that is between the liquid supply source and the liquid supply device; and a controller configured or programmed to control the liquid supply pump to be in at least one of an ON condition and an OFF condition. The pressure control valve closes the liquid supply path while the liquid supply device is OFF or at a stop.

With the above-described structure, while the liquid supply device is at a stop, the liquid supply path is closed by the pressure control valve. This maintains the nozzle of the injection head to have a negative pressure. Therefore, while the liquid supply system is not used, liquid leakage (e.g., ink leakage) from the injection head is prevented properly. In addition, the liquid supply source is allowed to be located at a position higher than that of the injection head, which increases the degree of freedom of design (layout) in the height direction. With the above-described structure, while the ink supply system is not used, it is not necessary to keep on crushing a portion of the liquid supply path. This prevents the above-described inconvenience. Therefore, while the liquid supply system is in use, the liquid is supplied to the injection head stably.

In a preferred embodiment of the present invention, the liquid supply path is located above the nozzle of the injection head with respect to a direction of gravity.

In the above-described preferred embodiment, the elevation head of the liquid supply source is higher than that of the injection head. In this state, the liquid easily leaks from the injection head. In such a case, a preferred embodiment of the present invention is very effective.

In another preferred embodiment of the present invention, the pressure control valve is located above the nozzle of the injection head with respect to a direction of gravity.

In the above-described preferred embodiment, the liquid moves smoothly from the pressure control valve toward the injection head by the self-weight thereof. Therefore, the liquid is supplied to the injection head more stably.

In the description of preferred embodiments of the present invention, "self-weight" refers to a load or gravitational force imposed by a body due to its mass.

In still another preferred embodiment of the present invention, the liquid supply source is located above the nozzle of the injection head with respect to a direction of gravity.

In the above-described preferred embodiment, the liquid moves smoothly from the pressure control valve toward the liquid supply path by the self-weight thereof. Therefore, the liquid is supplied to the injection head more stably.

In still another preferred embodiment of the present invention, the damper includes a detector detecting a storage amount of the liquid stored in the storage chamber. The controller is configured or programmed to actuate the liquid supply device when the storage amount of the liquid in the damper becomes a predetermined level or lower, and to stop the liquid supply device when the storage amount of the liquid in the damper becomes a predetermined maximum level, based on a result of detection of the detector.

In the above-described preferred embodiment, the liquid supply device is actuated in accordance with the storage amount of the liquid stored in the damper. This allows an appropriate amount of liquid to be transmitted to the damper at an appropriate timing. Thus, the liquid is supplied more stably.

In still another preferred embodiment of the present invention, the controller controls the liquid supply device such that the liquid supply device rotates at a constant rotation rate from being actuated until being stopped by the controller.

In the above-described preferred embodiment, the pressure fluctuation of the liquid is significantly reduced or prevented by the action of the damper. Therefore, while the injection head is injecting the liquid, the liquid supply device is driven at a constant rotation rate. Thus, the liquid supply device is controllable in a simple manner with no complicated process.

In still another preferred embodiment of the present invention, the pressure control valve includes a first pressure chamber to which the liquid flows; a second pressure chamber from which the liquid flows out; a communication opening communicating the first pressure chamber and the second pressure chamber to each other; and a valve member opening or closing the communication opening. A portion of a wall of the second pressure chamber is defined by a flexibly deformable pressure sensitive film. The valve member is coupled with the pressure sensitive film and opens or closes the communication opening by a pressing force provided by the flexible deformation of the pressure sensitive film in a thickness direction thereof.

In the above-described preferred embodiment, the communication opening is opened or closed in association with the flexible deformation of the pressure sensitive film. Therefore, the pressure control valve is simply controllable with no need to be electrically controlled.

In still another preferred embodiment of the present invention, the liquid supply system further includes a cap attachable to the injection head so as to cover the nozzle; and a suction pump absorbing a substance inside the cap.

In the above-described preferred embodiment, the liquid supply path is filled with the liquid in a preferred manner for, for example, maintenance or flushing. This prevents the liquid supply path from being contaminated with air bubbles, and thus a fault such as a printing defect or the like is prevented. In addition, in the case where the nozzle is clogged with a dried or solidified component, such a component is removed in a preferred manner.

In still another preferred embodiment of the present invention, the liquid supply path includes an elastically deformable tube. The liquid supply device includes a presser switchable between a pressing state in which the presser applies a pressing force to the tube to deform the tube and a releasing state in which the presser does not deform the tube. The controller actuates the suction pump in the state where the presser of the liquid supply device is in the releasing state.

In the above-described preferred embodiment, the liquid rushes into the injection head from the liquid supply source. Therefore, for example, for maintenance or flushing, the liquid supply path is filled with the liquid within a relative short time.

In still another preferred embodiment of the present invention, the liquid supply device includes a presser switchable between a pressing state in which the presser applies a pressing force to the tube to deform the tube and a releasing state in which the presser does not deform the tube. The controller, after actuating the suction pump for a predetermined time duration in the state where the presser of the liquid supply device is in the pressing state, puts the presser of the liquid supply device into the releasing state.

In the above-described preferred embodiment, a large pressure difference is caused between the liquid supply device and the suction pump. This generates a strong negative pressure area. Therefore, the liquid is supplied to the liquid supply path in a preferred manner while air bubbles are prevented from remaining in the liquid supply path.

In still another preferred embodiment of the present invention, the liquid supply source includes a first liquid tank storing the liquid; a second liquid tank storing the same liquid as the first liquid tank; a first liquid path connected with the first liquid tank and the second liquid tank; a second liquid path connected with the first liquid tank and the second liquid tank; and a liquid circulation pump provided on at least one of the first liquid path and the second liquid path.

In the above-described preferred embodiment, the liquid stored in the liquid supply source is stirred. For example, ink is a mixture of a coloring material and a solvent. Stirring the liquid appropriately prevents a solid content (e.g., coloring material) in the liquid from being separated or precipitated. Therefore, the stored liquid is maintained at a uniform quality.

In still another preferred embodiment of the present invention, the liquid supply source includes a first liquid tank storing the liquid; a second liquid tank storing the same liquid as the first liquid tank; a liquid circulation path usable to circulate the liquid stored in the second liquid tank; a liquid circulation pump provided on the liquid circulation path; and a differential pressure valve provided on the liquid circulation path.

In the above-described preferred embodiment, the liquid stored in the second liquid tank is stirred. Thus, the liquid is maintained at a uniform quality.

In still another preferred embodiment of the present invention, the second liquid tank is provided below the nozzle of the injection head with respect to a direction of gravity.

In the above-described preferred embodiment, it is not necessary to raise the liquid tank upward at the time of replacement of the liquid tank. Therefore, in the case where the liquid tank, especially, the second liquid tank is large and/or heavy, the load on the user is alleviated.

In still another preferred embodiment of the present invention, the liquid supply system further includes a liquid recovery path including one end in communication with a portion of the liquid supply path that is between the liquid supply source and the pressure control valve and another end in communication with the damper; and a three-way valve provided at a portion at which the liquid supply path and the liquid recovery path are in communication with each other.

In still another preferred embodiment of the present invention, the liquid supply system further includes a liquid recovery path including one end in communication with a portion of the liquid supply path that is between the liquid supply source and the pressure control valve and another end in communication with the damper; a communication portion at which the liquid supply path and the liquid recovery path are in communication with each other; a first valve provided on the liquid recovery path; and a second valve provided on a portion of the liquid supply path that is between the liquid supply source and the communication portion.

In a preferred embodiment in which the three-way valve or two valves are provided at a portion at which the liquid supply path and the liquid recovery path are in communication with each other, the liquid is circulated in the liquid supply system. This prevents the solid content in the liquid (e.g., coloring material) from being separated or precipitated highly certainly.

In still another preferred embodiment of the present invention, the liquid supply source includes a first liquid tank storing the liquid; a second liquid tank storing the same liquid as the first liquid tank; a first liquid path in communication with the first liquid tank; a second liquid path in communication with the second liquid tank; and a three-way valve connected with the first liquid path, the second liquid path and the liquid supply path. The liquid supply system further includes a liquid recovery path including an end in communication with the first liquid tank and another end in communication with the damper. The liquid recovery path is provided with a one-way valve preventing the liquid from flowing from the first liquid tank toward the damper. The controller controls switching of the three-way valve.

In still another preferred embodiment of the present invention, the liquid supply source includes a first liquid tank storing the liquid; a second liquid tank storing the same liquid as the first liquid tank; a first liquid path in communication with the first liquid tank; a second liquid path in communication with the second liquid tank; a communication portion communicating the first liquid path, the second liquid path and the liquid supply path to each other; a first valve provided on the first liquid path; and a second valve provided on the second liquid path. The liquid supply system further includes a liquid recovery path including an end in communication with the first liquid tank and another end in communication with the damper. The liquid recovery path is provided with a one-way valve preventing the liquid from flowing from the first liquid tank toward the damper. The controller controls switching of the first valve and the second valve.

In a preferred embodiment in which the one-way valve is provided, even in the case where the hydraulic head difference between the liquid tank and the injection head is especially large, the liquid does not flow oppositely from the first liquid tank toward the damper. Therefore, the liquid is circulated in the ink supply system stably.

In still another preferred embodiment of the present invention, the liquid supply source includes a first liquid tank storing the liquid; a second liquid tank storing the same liquid as the first liquid tank; a first liquid path in communication with the first liquid tank; a second liquid path in communication with the second liquid tank; and a three-way valve connected with the first liquid path, the second liquid path and the liquid supply path. The liquid supply system further includes a liquid recovery path including an end in communication with the first liquid tank and another end in communication with the damper. The controller controls switching of the three-way valve.

In still another preferred embodiment of the present invention, the liquid supply source includes a first liquid tank storing the liquid; a second liquid tank storing the same liquid as the first liquid tank; a first liquid path in communication with the first liquid tank; a second liquid path in communication with the second liquid tank; a communication portion communicating the first liquid path, the second liquid path and the liquid supply path to each other; a first valve provided on the first liquid path; and a second valve provided on the second liquid path. The liquid supply system further includes a liquid recovery path including an end in communication with the first liquid tank and another end in communication with the damper. The controller controls switching of the first valve and the second valve.

In the above-described preferred embodiment, even in the case where a plurality of liquid tanks are provided, the liquid is circulated in the liquid supply system. This prevents the solid content in the liquid (e.g., coloring material) from being separated or precipitated highly certainly.

In a preferred embodiment of the present invention, the controller is configured or programmed to control the liquid supply pump to be in an intermediate power condition with a power that is between the ON condition and the OFF condition.

Preferred embodiments of the present invention also provide an inkjet recording device including the above-described liquid supply system.

According to various preferred embodiments of the present invention, while the liquid supply system is used, the liquid is supplied to the head stably. While the liquid supply system is not used, the liquid is prevented from leaking from the head.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, liquid supply systems and inkjet recording devices according to preferred embodiments of the present invention will be described with reference to the drawings. The preferred embodiments of the present invention described herein do not limit the present invention. Elements or features having the same function will be assigned the same reference signs, and repetitive descriptions will be omitted or simplified. In the following description, the term "height" refers to the length in the direction of gravity (vertical direction) in the state where the liquid supply system is properly located at a predetermined position with a predetermined posture. The terms "upper", "lower", "upward", "downward", "above", "below" "lower surface" and the like are based on the direction of gravity in the state where the liquid supply system is properly located at a predetermined position with a predetermined posture. The term "stop" used for the liquid supply device refers to a general state where the liquid supply system is not driven and encompasses a state where the power supply is turned off and also, for example, a standby state in which the power is on.

Figure 1:
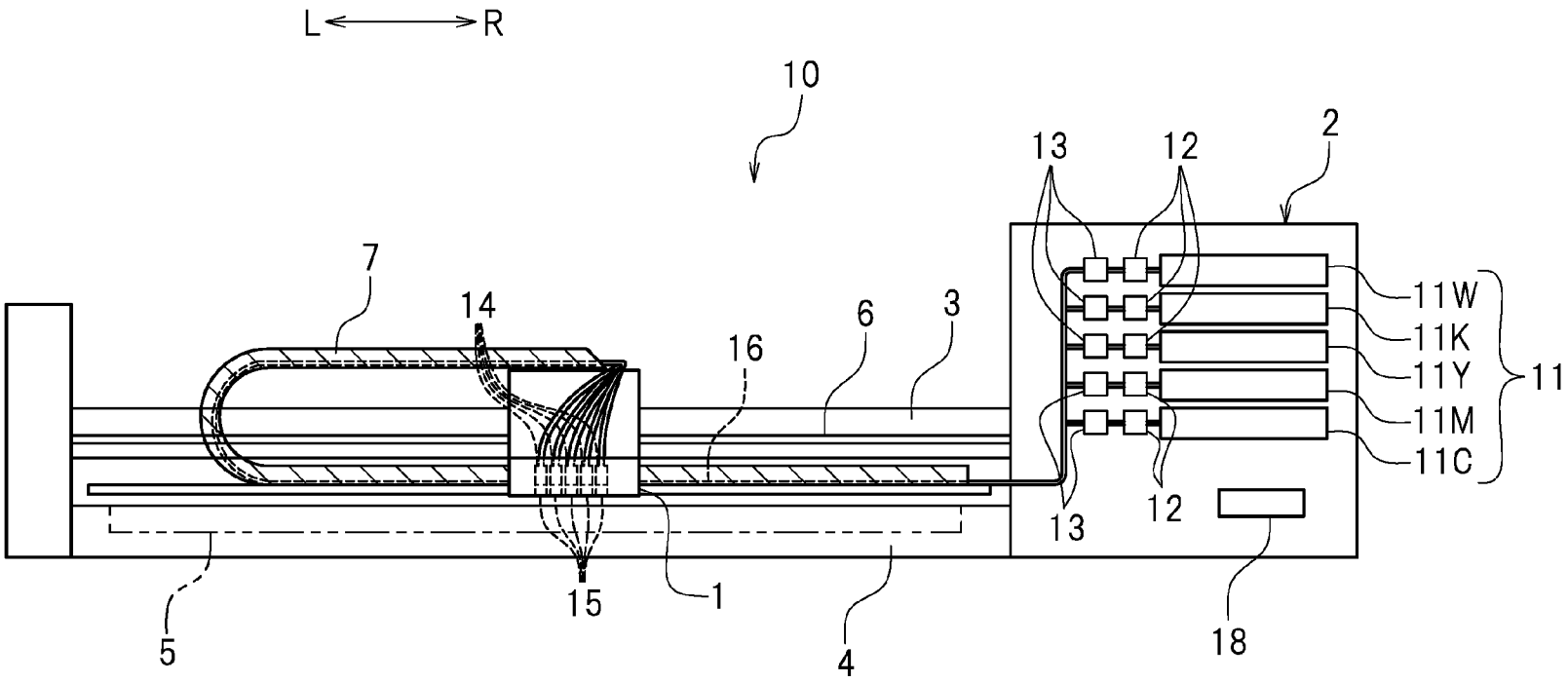
FIG. 1 is a front view of an inkjet printer according to preferred embodiment 1 of the present invention.
Figure 2:
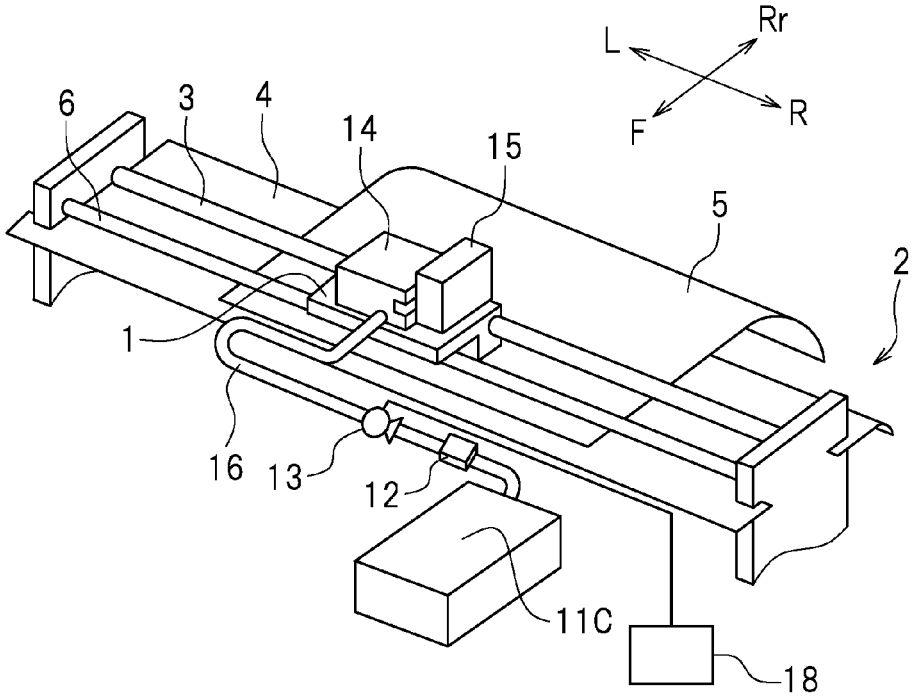
FIG. 2 is a partial perspective view of the inkjet printer shown in FIG. 1.

FIG. 1 is a front view of an inkjet printer (hereinafter, referred to as a "printer") 10 according to preferred embodiment 1 of the present invention. The printer 10 is an example of an inkjet recording device. In FIG. 1 and FIG. 2, reference signs L and R respectively refer to "left" and "right". It should be noted that these directions are merely provided for the sake of convenience, and do not limit the manner of installation of the printer 10 in any way. The printer 10 performs printing on a recording paper sheet 5, which is a recording medium. The "recording medium" encompasses paper such as plain paper or the like, and also a recording medium formed of a resin material such as polyvinyl chloride (PVC), polyester or the like and a recording medium formed of any of various other materials such as aluminum, iron, wood or the like.

The printer 10 includes a printer main body 2, and a guide rail 3 secured to the printer main body 2. The guide rail 3 extends in a left-right direction. The guide rail 3 is in engagement with a carriage 1. The guide rail 3 is provided with a roller (not shown) at each of a left end and a right end thereof. One roller among these rollers is coupled with a carriage motor (not shown). The one roller is drivable to rotate by the carriage motor. Both of the rollers are each wound around by an endless belt 6. The carriage 1 is secured to the belt 6. When the rollers rotate and the belt 6 runs, the carriage 1 moves in the left-right direction. In this manner, the carriage 1 moves reciprocally in the left-right direction along the guide rail 3.

The printer main body 2 includes a platen 4 supporting the recording paper sheet 5. The platen 4 is provided with a pair of rollers, namely, an upper grid roller and a lower pinch roller (not shown). The grid roller is coupled with a field motor (not shown). The grid roller is drivable to rotate by the field motor. When the grid roller rotates in the state where the recording paper sheet 5 is held between the grid roller and the pinch roller, the recording paper sheet 5 is transported in a front-rear direction.

The printer main body 2 is provided with a plurality of ink cartridges 11. The ink cartridges 11 are each a tank (ink supply source) storing ink. The ink cartridges 11 are each an example of liquid supply source. Specifically, the plurality of the ink cartridges 11C, 11M, 11Y, 11K and 11W are detachably attached to the printer main body 2. The ink cartridge 11C stores cyan ink. The ink cartridge 11M stores magenta ink. The ink cartridge 11Y stores yellow ink. The ink cartridge 11K stores black ink. The ink cartridge 11W stores white ink. The ink cartridges 11 each include an ink removal outlet (not shown) attached thereto.

The printer 10 includes an ink supply system for ink of each of colors. The ink supply system includes the ink cartridge 11, and also includes an ink head 15, a damper 14, an ink supply path 16, a supply pump 13, a pressure control valve 12, and a controller 18. The ink head 15 and the damper 14 are mounted on the carriage 1 and reciprocally move in the left-right direction. By contrast, the ink cartridge 11 is not mounted on the carriage 1 and does not reciprocally move in the left-right direction. A majority of the ink supply path 16 (at least half of the total length thereof) is located as extending in the left-right direction so as not to be broken even when the carriage 1 moves in the left-right direction. In this preferred embodiment, five types of ink preferably are used, for example, and therefore, a total of five ink supply paths 16 are preferably provided, for example. The ink supply paths 16 are covered with a cable protection and guide device 7. The cable protection and guide device 7 is, for example, a cableveyor (registered trademark).

Figure 3:
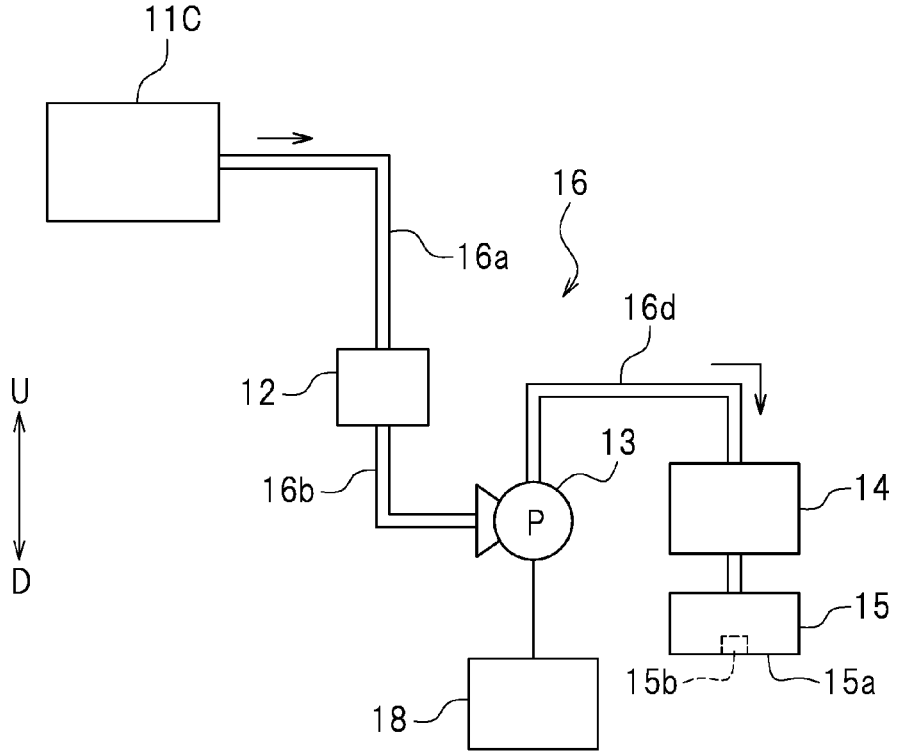
FIG. 3 is a block diagram showing a structure, of the inkjet printer shown in FIG. 2, in which ink is supplied from an ink cartridge to an ink head.

In the following description, the ink head 15, the damper 14, the ink supply path 16, the supply pump 13 and the pressure control valve 12 provided for the ink cartridge 11C storing cyan ink will be explained as an example. FIG. 2 is a partial perspective view of the printer 10. FIG. 3 is a schematic view showing a structure in which the ink is supplied from the ink cartridge 11C to the ink head 15. In FIG. 3, the arrows represent the direction of flow of the ink during the printing. In FIG. 2, reference signs F and Rr respectively refer to "front" and "rear". In FIG. 3 and the like, reference signs U and D respectively refer to "up" and "down" regarding the direction of gravity.

The ink head 15 injects the ink. The ink head 15 is an example of injection head. On a lower surface 15*a* of the ink head 15, a plurality of nozzles 15*b*, through which the ink is to be injected, are provided. The lower surface 15*a* of the ink head 15 (surface on the side of the nozzles 15*b*) is maintained to receive a pressure lower than, or equal to, the atmospheric pressure (negative pressure; e.g., about −50 $mmH_2O$) so that the ink does not leak. The above-described pressure level is merely an example, and may be changed appropriately. Inside the ink head 15, an actuator (not shown) including a piezoelectric element or the like is provided. The actuator is driven to inject the ink from the nozzles 15*b*. In this preferred embodiment, as shown in FIG. 3, the ink head 15 is provided at a position lower than that of the ink cartridge 11C. In other words, the ink cartridge 11C is located at a position higher than that of the nozzles 15*b* of the ink head 15. With such a structure, the hydraulic head of the ink cartridge 11C is higher than that of the ink head 15. In this state, the ink easily leaks from the nozzles 15*b* of the ink head 15 while the printing is not performed (e.g., while the printer 10 is at a stop). In such a case, the printer 10 is very effective. It should be noted that the ink head 15 may be provided at a position of about the same height as that of the ink cartridge 11C. The ink head 15 may be provided at a position higher than that of the ink cartridge 11C. The ink head 15 may be movable arbitrarily in a height direction.

Figure 4:
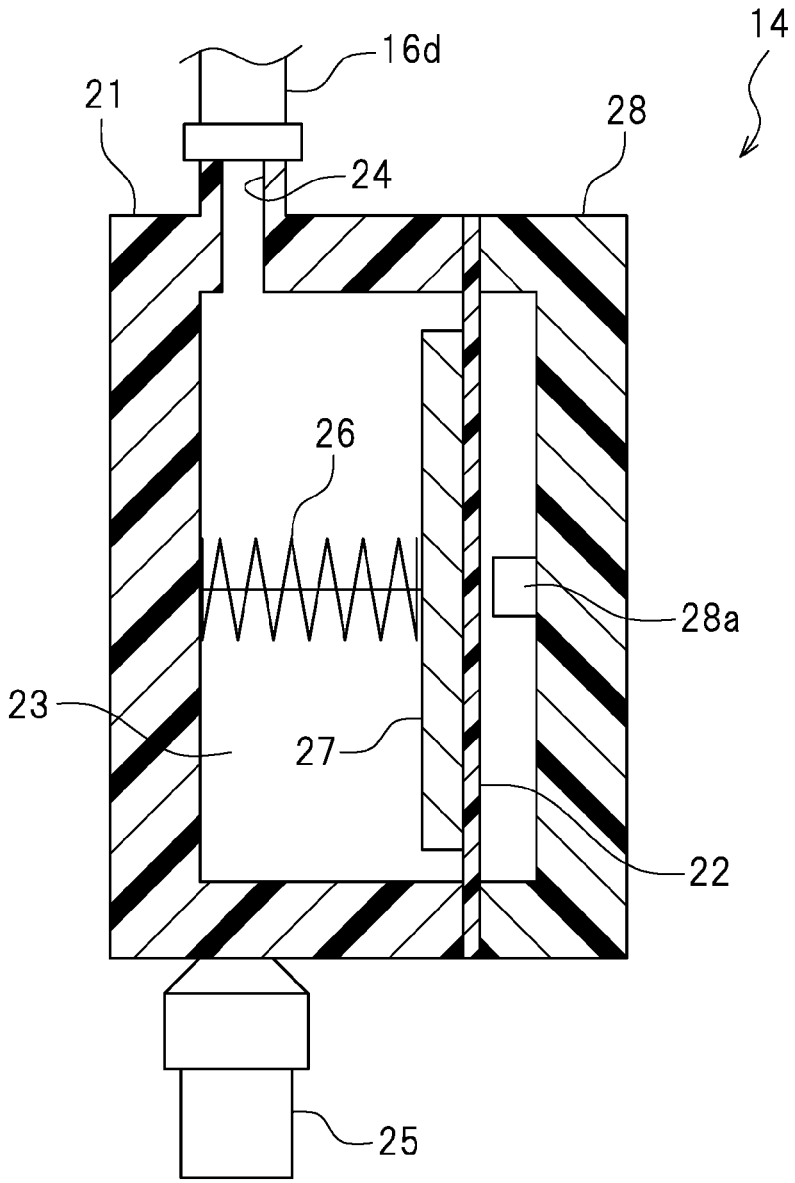
FIG. 4 is a vertical cross-sectional view showing a structure of a damper.

The damper 14 is in communication with the ink head 15 and has a role of supplementing the ink to the ink head 15. The damper 14 also alleviates the pressure fluctuation of the ink. The damper 14 stabilizes the ink injection operation of the ink head 15. FIG. 4 is a vertical cross-sectional view of the damper 14. As shown in FIG. 4, the damper 14 in this preferred embodiment does not have a valve structure. The damper 14 includes a damper main body 21 having a substantially U-shaped cross-section to be provided with an opening at one surface and a damper film 22 provided so as to cover the opening of the damper main body 21. An area enclosed by the damper main body 21 and the damper film 22 is an ink storage chamber 23. An ink inlet 24 is provided in an upper surface of damper main body 21 on the side closer to the viewer of FIG. 4. An ink outlet 25 is provided in a lower surface of damper main body 21 on the side farther from the viewer of FIG. 4. The ink inlet 24 is connected with an end of the ink supply path 16. The ink outlet 25 is connected with the ink head 15.

The damper main body 21 is preferably formed of a resin. The damper film 22 is preferably a flexible film formed of a resin. The damper film 22 is bonded to an edge of the damper main body 21 at such a tensile strength as to be flexibly deformable internally toward, or externally away from, the ink storage chamber 23. The ink storage chamber 23 temporarily stores the ink. Outside of the damper film 22, a cover body 28 having a substantially U-shaped cross-section is provided.

An end of a coil spring 26 is attached to the damper main body 21. The coil spring 26 supports a pressing body 27 at the other end thereof. The coil spring 26 is an example of elastic member pressing the pressing body 27 toward the damper film 22. There is no specific limitation on the structure of the pressing body 27. In this preferred embodiment, the pressing body 27 is a flat plate formed of stainless steel. The pressing body 27 presses the damper film 22 uniformly or substantially uniformly. The coil spring 26 is maintained in a compressed state. Therefore, the damper film 22 is kept pressed externally away from the ink storage chamber 23 (rightward in FIG. 4). The ink storage chamber 23 has a capacity that is changeable by the coil spring 26 extending or contracting and thus the damper film 22 being flexibly deformed.

In a preferred embodiment of the present invention, the damper 14 includes an ink storage amount detector that detects the amount of the ink stored in the ink storage chamber 23. The ink storage amount detector detects, for example, whether or not the amount of the ink in the ink storage chamber 23 is a predetermined level or lower. There is no specific limitation on the structure of the ink storage amount detector. In this preferred embodiment, a photosensor 28*a* is provided on the cover body 28 located outside of the damper film 22, and the amount of the ink stored in the ink storage chamber 23 is detected based on the positional change of the damper film 22. When the amount of the ink stored in the ink storage chamber 23 is decreased to be small, the damper film 22 is flexibly deformed internally toward the ink storage chamber 23. Then, the photosensor 28*a* optically detects the flexible deformation of the damper film 22. In this manner, it is determined that the amount of the ink in the ink storage chamber 23 is of a predetermined capacity or less. Instead of the photosensor 28*a*, for example, a pressure gauge may be provided in the ink storage chamber 23. The pressure gauge may be used to determine whether or not the amount of the ink stored in the ink storage chamber 23 is of the predetermined capacity or less based on the pressure change in the ink storage chamber 23.

The ink cartridge 11C and the damper 14 are in communication with each other via the ink supply path 16. An end of the ink supply path 16 is in communication with the ink removal opening of the ink cartridge 11C. The other end of the ink supply path 16 is in communication with the ink inlet 24 of the damper 14. The ink supply path 16 defines a flow path guiding the ink from the ink cartridge 11C to the damper 14 and further to the ink head 15. The ink supply path 16 is soft and flexible, and is elastically deformable. The ink supply path 16 is an example of liquid supply path. There is no specific limitation on the structure of the ink supply path 16. In this preferred embodiment, the ink supply path 16 is a deformable tube formed of a resin. The ink supply path 16 may be a member other than a tube. A portion of the ink supply path 16 may be formed of a tube.

In this preferred embodiment, the ink supply path 16 includes tube portions 16*a*, 16*b*, 16*c* and 16*d*. The tube portion 16*a* communicates the ink cartridge 11C and the pressure control valve 12 to each other. The tube portion 16*b* communicates the pressure control valve 12 and the supply pump 13 to each other. The tube portion 16*c* is an ink supply path in the supply pump 13. The tube portion 16*d* communicates the supply pump 13 and the damper 14 to each other. The damper 14 is connected with the ink head 15. The ink is supplied from the ink cartridge 11C to the ink head 15 in such a route.

Figure 5:
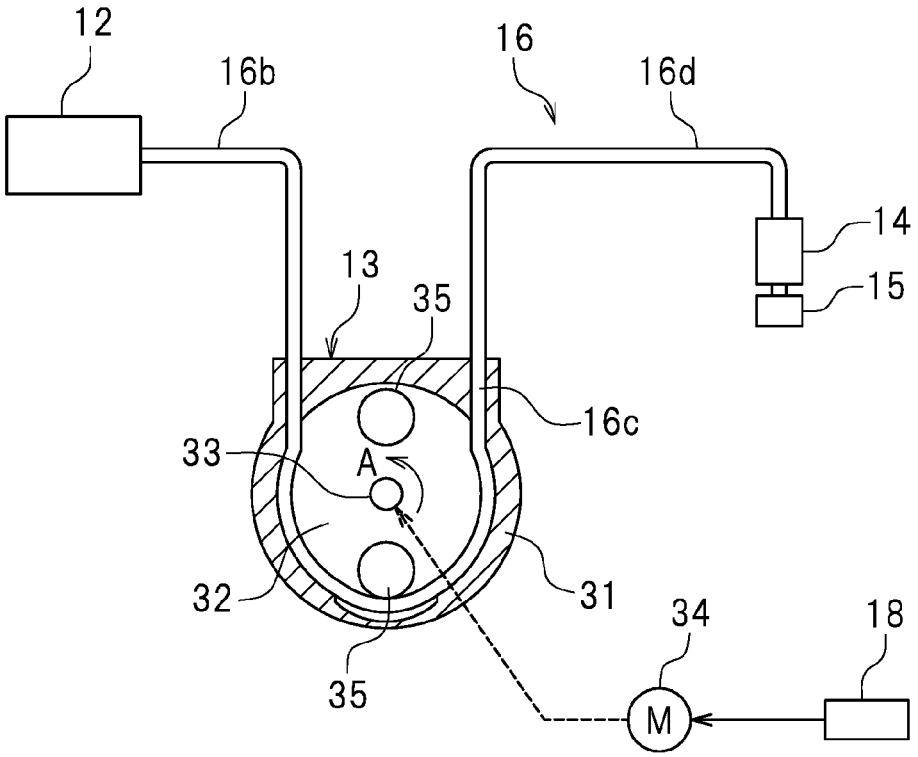
FIG. 5 is a vertical cross-sectional view showing a structure of a supply pump.

The supply pump 13 is provided on the ink supply path 16. The supply pump 13 is a device that supplies the ink from the ink cartridge 11C toward the damper 14. The supply pump 13 is an example of liquid supply device. FIG. 5 is a vertical cross-sectional view showing a structure of the supply pump 13. In this preferred embodiment, the supply pump 13 is a tube pump of, for example, a trochoid pump system. The tube pump (supply pump 13) defines and functions as both as a liquid transmitter and a presser. The liquid transmitter transmits the ink toward the tamper 14. The presser is switchable between a pressing state in which the presser applies a pressing force to the tube portion 16*c* to deform the tube portion 16*c*, and a releasing state in which the presser does not deform the tube portion 16*c*. Use of the tube pump acting both as the liquid transmitter and the presser decreases the number of components of the ink supply system and simplifies the structure of the ink supply system. Herein, the term "press" refers to giving a pressure at such a degree as to make a dent in a cross-section of the tube portion 16*c* (deform the cross-section of the tube portion 16*c*). Therefore, the term "press" does not necessarily refer to pressing the tube portion 16*c* until the cross-section thereof is completely closed.

In this preferred embodiment, the supply pump 13 includes a frame 31, the tube portion 16*c* located to be substantially U-shaped in the frame 31, and a wheel 32 rotatably located in the frame 31. An end of the tube portion 16*c* is connected with the pressure control valve 12 via the tube portion 16*b* of the ink supply path 16. The other end of the tube portion 16*c* is connected with the damper 14 via the tube portion 16*d*. At a center of the wheel 32, a driving shaft 33 is provided. The driving shaft 33 is coupled with a motor 34. The motor 34 is connected with the controller 18, and is controlled by the controller 18. The wheel 32 is provided with two cylindrical pressing rollers 35. The two pressing rollers 35 face each other while having the driving shaft 33 therebetween.

While the supply pump 13 is at a stop, the two pressing rollers 35 are located at a predetermined wait position, at which the two pressing rollers 35 are not in contact with the tube portion 16*c*. Namely, when the supply pump 13 stops, the two pressing rollers 35 move internally in a radial direction of the driving shaft 33. Thus, the tube portion 16*c* is maintained in a released state. By contrast, when the supply pump 13 is driven by the controller 18, the two pressing rollers 35 move externally in the radial direction of the driving shaft 33. When the motor 34 is driven in this state, the driving shaft 33 rotates. When the driving shaft 33 rotates, the wheel 32 rotates. In accordance with the rotation of the wheel 32, the pressing rollers 35 revolve around the driving shaft 33. While revolving, the pressing rollers 35 press various portions of the tube portion 16*c* sequentially. As a result, a pressure is generated in the tube portion 16*c*, and the ink in the tube portion 16*c* is supplied in a direction in which the pressing rollers 35 move (in this example, direction A). Namely, while the supply pump 13 is actuated, the tube portion 16*c* is put into a pressed state of being pressed by the pressing rollers 35. In this preferred embodiment, the presser includes the pressing rollers 35, and the liquid transmitter includes the driving shaft 33, the wheel 32 and the pressing rollers 35.

In the above-described preferred embodiment, the supply pump 13 preferably is a tube pump. There is no specific limitation on the type of the supply pump 13. For example, the liquid supply device may include a combination of a device dedicated for liquid transmission that transmits the liquid from the ink cartridge 11C toward the damper 14, and a presser that switches the tube 16*c* between the pressed state and the released state. An example of the liquid transmission device is a diaphragm pump (membrane pump), and an example of the presser is a pressing roller member. There is no specific limitation on the order of connection of the liquid transmission device and the presser. Either the liquid transmission device or the presser may be located on the side of the damper 14. In the case where the liquid transmission device and the presser are provided as separate components, the liquid transmission device and the presser are each connected with the controller. The presser is also connected with a motor. The controller controls the liquid transmission device to be actuated or stopped, and also controls the presser to be in the pressing state or in the releasing state. When the controller drives the motor, the presser puts a predetermined portion of the tube into the pressed state. When the motor is stopped, this portion is released from the pressed state. In an example, the liquid transmission device is actuated while the pressing roller member is switched between the pressing state and the releasing state in repetition at a predetermined time interval. In this manner, the ink is transmitted toward the damper 14 like in the case where the tube pump is used.

The pressure control valve 12 controls the nozzles 15*b* of the ink head 15 to have a negative pressure when the supply pump 13 is at a stop to prevent ink leak. The pressure control valve 12 is provided on the ink supply path 16. In this preferred embodiment, the pressure control valve 12 is provided between the ink cartridge 11C and the supply pump 13.

Figure 6:
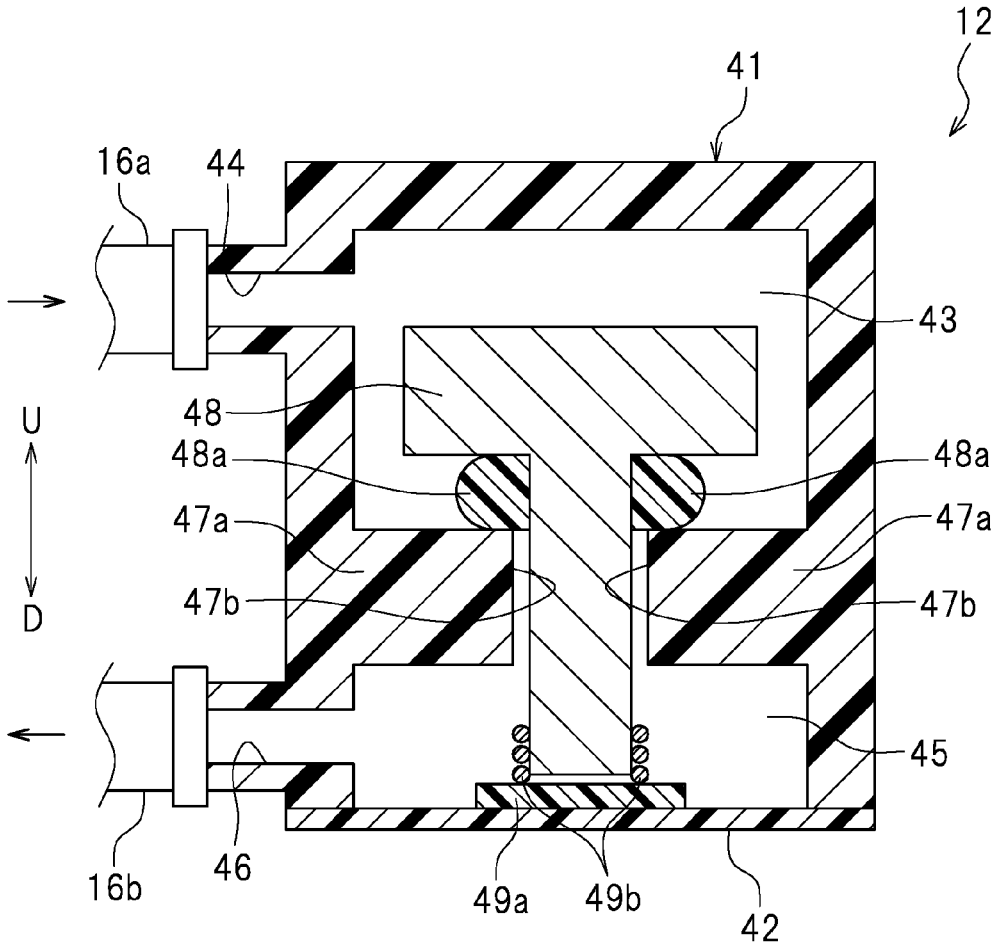
FIG. 6 is a vertical cross-sectional view showing a structure of a pressure control valve.

In this preferred embodiment, the pressure control valve 12 is secured on a still predetermined table (e.g., the printer main body 2) such that a lower surface thereof is perpendicular or substantially perpendicular to the direction of gravity. In such a structure, the amount of the ink to be supplied is adjusted with higher precision than in the case where, for example, the pressure control valve 12 and the ink head 15 are both mounted on the carriage 1. Namely, the pressure control valve 12 is configured such that a valve member thereof is opened or closed based on a flexible deformation of a pressure sensitive film 42 (FIG. 6). Therefore, in the structure in which the pressure control valve 12 is not mounted on the carriage 1 and is secured to a stable member, the actuation precision of the valve structure is improved. As a result, the amount of the ink to be supplied is adjusted more stably. The lower surface of the pressure control valve 12 is located at a position lower than that of a lower surface of the ink cartridge 11C. The lower surface of the pressure control valve 12 is located at a position higher than that of the surface of the ink head 15 on the side of the nozzles 15*b* (lower surface 15*a*). In such a structure, the ink moves smoothly toward the ink head 15 by a self-weight of the ink. Therefore, the ink is supplied to the ink head more stably.

FIG. 6 is a vertical cross-sectional view showing a structure of the pressure control valve 12. As shown in FIG. 6, the pressure control valve 12 includes a hollow case main body 41 and the pressure sensitive film 42 is flexibly deformable in a thickness direction by a pressure load. Namely, the pressure control valve 12 in this preferred embodiment is a diaphragm system. The case main body 41 is preferably formed of a resin. An inner space of the case main body 41 is divided into two spatial areas in an up-down direction. In other words, a partition wall 47*a* dividing the inner space of the case main body 41 in the height direction is provided inside the case main body 41 into the two spatial areas. An upper spatial area enclosed by the case main body 41 and the partition wall 47*a* is a first pressure chamber 43. An ink inlet 44, through which the ink flows into the first pressure chamber 43, is provided in a left wall of the first pressure chamber 43. The ink inlet 44 is in communication with the ink cartridge 11C via the tube portion 16*a* of the ink supply path 16.

The case main body 41 is open in a lower surface thereof, and the pressure sensitive film 42 is attached so as to cover the opening. The pressure sensitive film 42 is located perpendicular or substantially perpendicular with respect to the direction of gravity. A lower spatial area enclosed by the case main body 41, the pressure sensitive film 42 and the partition wall 47*a* is a second pressure chamber 45. The pressure sensitive film 42 is preferably a flexible resin film. The pressure sensitive film 42 is attached to an edge of the lower surface of the case main body 41 at such a tensile strength as to be flexibly deformable internally toward the second pressure chamber 45. An ink outlet 46, through which the ink flows out of the second pressure chamber 45, is provided in a left wall of the second pressure chamber 45. The ink outlet 46 is in communication with the damper 14 via the tube portion 16*b* of the ink supply path 16.

A portion of the partition wall 47*a* is provided with a communication opening 47*b* communicating the first pressure chamber and the second pressure chamber 45 to each other. In the communication opening 47*b*, a valve rod (valve member) 48 having a T-shaped vertical cross-section is located. The valve rod 48 extends from the first pressure chamber 43 toward the second pressure chamber 45 so as to pass the partition wall 47*a* (downward in FIG. 6). The valve rod 48 extends parallel or substantially parallel to the direction of gravity. An end of the valve rod 48 is coupled with the pressure sensitive film 42. The valve rod 48 is movable in a longitudinal direction thereof (vertical direction) in association with displacement (degree of flexible deformation) of the pressure sensitive film 42. This opens or closes the communication opening 47*b*. In the first pressure chamber 43, the valve rod 48 is provided with a sealing member 48*a*. The sealing member 48*a* is an elastic body (e.g., formed of rubber).

The valve rod 48 may be preferably formed of a material having a high ink corrosion resistance. The valve rod 48 is preferably formed of a metal material, for example, brass, copper, silver, platinum, gold, stainless steel or the like. Among these materials, the valve rod 48 may be preferably formed of brass having a large specific gravity. This increases the weight (self-weight) of the valve rod 48. Therefore, when the pressure sensitive film 42 is not flexibly deformed, the buoyancy of the valve rod 48 is significantly reduced and the valve rod 48 is pressed in the direction of gravity by the self-weight thereof. This maintains the communication opening 47*b* in a closed state in a preferred manner. A general pressure control valve requires an urging member (e.g., seal spring) that press the valve rod to a partition wall to urge the valve rod to a closing position. By contrast, the above-described structure allows the communication opening 47*b* to be maintained in the closed state stably without the use of the urging member.

A pressure receiving body 49*a* is in contact with the end of the valve rod 48 on the side of the second pressure chamber 45. The pressure receiving body 49*a* is located perpendicularly or substantially perpendicularly to the end of the valve rod 48. The pressure receiving body 49*a* is provided on a surface of the pressure sensitive film 42. The pressure receiving body 49*a* allows the displacement of the pressure sensitive film 42, caused by the flexible deformation thereof, to be transmitted to the valve rod 48 stably. There is no specific limitation on the structure of the pressure receiving body 49*a*. In this preferred embodiment, the pressure receiving body 49*a* is a disc-shaped member formed of a resin.

An end of a cylindrical coil spring 49*b* is secured to a surface of the pressure receiving body 49*a* on the side of the valve rod 48. The coil spring 49*b* has a winding diameter that is slightly larger than a diameter of the end of the valve rod 48. The coil spring 49*b* is formed so as to allow the end of the valve rod 48 to be inserted thereinto. The coil spring 49*b* prevents the pressure sensitive film 42 from being flexibly deformed externally away from the second pressure chamber 45 (downward in FIG. 6). This maintains an inner pressure of the pressure control valve 12 to be a negative pressure. Namely, the coil spring 49*b* acts as a negative pressure maintaining member. In this preferred embodiment, the inner pressure of the second pressure chamber 45 is maintained at about −100 $mmH_2O$, for example. The pressure difference between the pressure control valve 12 (in terms of design, the center thereof in the height direction) and the lower surface 15*a* of the ink head 15 is maintained at about 50 $mmH_2O$, for example. With such an arrangement, the effect of a preferred embodiment of the present invention that the ink leak from the ink head 15 is prevented is better exhibited. It should be noted that the above-described values of the pressure are merely examples, and may be changed appropriately.

While the printing is not performed, namely, while the supply pump 13 is at a stop, the ink of an amount exceeding a predetermined amount is stored in the second pressure chamber 45. Therefore, the valve rod 48 is pressed to the partition wall 47*a* by the self-weight thereof. This maintains the communication opening 47*b* in a closed state. In other words, the communication opening 47*b* is not opened unless the amount of the ink in the second pressure chamber 45 is decreased. With this structure, the lower surface 15*a* of the ink head 15 is maintained to receive a negative pressure by the atmospheric pressure. As a result, the ink leakage from the ink head 15 is prevented properly. With the above-described structure, there is no need to maintain the ink supply path 16 in the pressed state. Therefore, the tube is prevented from being deteriorated.

By contrast, during the printing, when the supply pump 13 is driven, the ink in the second pressure chamber 45 is absorbed and is transmitted to the damper 14. Then, the amount of the ink stored in the second pressure chamber 45 is decreased to generate a negative pressure state in the second pressure chamber 45. As a result, the pressure sensitive film 42 is pressed by the atmospheric pressure to be flexibly deformed internally toward the second pressure chamber 45 (upward in FIG. 6). This motion of the pressure sensitive film 42 pushes up the valve rod 48 in the longitudinal direction thereof against the weight of the valve rod 48 itself (against the self-weight of the valve rod 48). As a result, the valve rod 48 is separated from the partition wall 47*a* to open the communication opening 47*b*. When the communication opening 47*b* is opened, the ink flows from the first pressure chamber 43 into the second pressure chamber 45.

As the ink flows into the second pressure chamber 45, the pressure difference between the second pressure chamber 45 and the outside of the pressure sensitive film 42 is decreased. Along with this, the flexible deformation of the pressure sensitive film 42 is alleviated. This moves the valve rod 48 downward in the longitudinal direction thereof by the self-weight thereof. When, as a result, the valve rod 48 contacts the partition wall 47*a*, the communication opening 47*b* is closed. The valve rod 48 moves relatively smoothly by use of the self-weight thereof. Therefore, the fluctuation in the pressure of the ink (pulsation) caused by the opening and closing of the communication opening 47*b* is significantly reduced or prevented. With the above-described structure, the communication opening 47*b* is opened or closed in association with the flexible deformation of the pressure sensitive film 42. Therefore, the pressure control valve 12 is simply controllable with no need to be electrically controlled.

The controller 18 is configured or programmed to control the supply pump 13 to be actuated or stopped. Thus, the controller 18 is configured or programmed to control the supply of the ink from the ink cartridge 11C to the ink head 15. The controller 18 is preferably a computer. The controller 18 may include a central processing unit (CPU) and a ROM or a RAM storing a program or the like to be executed by the CPU.

When the printing is started, the supply pump 13 is driven by the controller 18. At the same time, the ink is injected toward the recording paper sheet 5 from the nozzles 15*b* of the ink head 15. When the ink is injected, the ink stored in the damper 14 is supplied to the ink head 15. When the amount of the ink stored in the damper 14 becomes small, the controller 18 drives the supply pump 13. As a result, the ink in the second pressure chamber 45 of the pressure control valve 12 is transmitted to the damper 14. When the amount of the ink stored in the second pressure chamber 45 is decreased, the valve rod 48 opens the communication opening 47*b* as described above, and the ink flows from the first pressure chamber 43 to the second pressure chamber 45. The first pressure chamber 43 of the pressure control valve 12 is in communication with the ink cartridge 11C. Therefore, the ink is supplemented from the ink cartridge 11C to the first pressure chamber 43 by the decreased amount. In this manner, during the printing, the ink is supplied from the ink cartridge 11C to the ink head 15 stably.

In a preferred embodiment of the present invention, the controller 18 controls the supply pump 13 to be actuated or stopped based on the result of detection by the ink storage amount detector provided in the damper 14. More specifically, when the amount of the ink stored in the ink storage chamber 23 of the damper 14 is decreased to a predetermined value or less, a signal is output to the controller 18. Upon receipt of the signal, the controller 18 drives the supply pump 13. The supply pump 13 is kept actuated for a certain time duration. When the amount of the ink stored in the ink storage chamber 23 reaches a predetermined maximum value, a signal is output to the controller 18. Upon receipt of the signal, the controller 18 stops the supply pump 13. With this structure, the supply pump 13 is actuated in accordance with the amount of the liquid in the damper 14. This allows an appropriate amount of liquid to be transmitted to the damper 14 at an appropriate timing. Thus, the liquid is supplied more stably.

In another preferred embodiment, the controller 18 controls the supply pump 13 (liquid supply device) such that the supply pump 13 is driven at a certain rotation rate from being started until being stopped. Namely, the controller 18 does not need to change the rotation rate of the supply pump 13 in accordance with, for example, the pressure of the ink. In this preferred embodiment, the pressure fluctuation of the ink is significantly reduced or prevented by the action of the damper 14. Therefore, the supply pump 13 is controllable in a simple manner with no complicated process.

Figure 7:
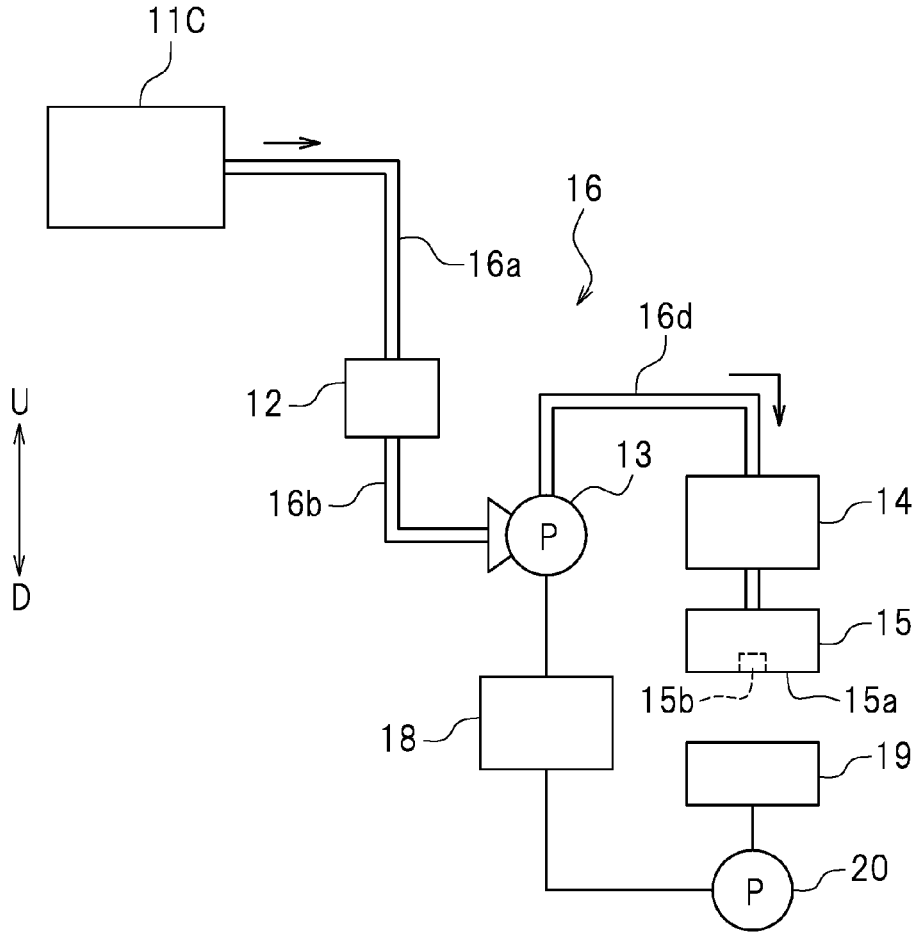
FIG. 7 is a block diagram showing a structure in which ink is supplied from an ink cartridge to an ink head in preferred embodiment 2 of the present invention.

Now, a printer according to preferred embodiment 2 of the present invention will be described. FIG. 7 is a block diagram showing a structure in which the ink is supplied from the ink cartridge 11C to the ink head 15 in preferred embodiment 2. In preferred embodiment 2, the ink supply system includes a cap 19 and a suction pump 20. The structure of the ink supply system is substantially the same as that of preferred embodiment 1 described above except for the cap 19 and the suction pump 20. The cap 19 is attached to the ink head 15 so as to cover the nozzles 15*b* provided on the lower surface 15*a* of the ink head 15 while the printing is not performed. The cap 19 prevents the ink attached to the ink head 15 from being dried, and thus the nozzles 15*b* are prevented from being clogged. The suction pump 20 absorbs a substance (e.g., ink) in the nozzles 15*b*. The suction pump 20 is connected with the cap 19. The suction pump 20 is connected with a motor (not shown). The motor is connected with the controller 18, and is controlled by the controller 18. When the motor is driven in the state where the cap 19 is attached to the ink head 15, the suction pump 20 is actuated to absorb the substance in the cap 19. If, for example, the printer 10 is not used for a long time, the nozzles 15*b* may be clogged with the ink that is dried and solidified. With the above-described structure, the dried and solidified ink is removed in a preferred manner. Thus, the printing is performed stably.

The above-described structure is also preferably usable to fill the ink supply path 16 with a liquid (e.g., ink or washing liquid) for, for example, maintenance or flushing of the printer 10. In a preferred embodiment, first, the cap 19 is attached to the nozzles 15*b* of the ink head 15. Next, the motor is driven by the controller 18 to actuate the suction pump 20. At this point, the presser of the supply pump 13 is put into the releasing state by the controller 18. Preferably, the supply pump 13 is stopped by the controller 18. With the above-described structure, the liquid rushes into the ink head 15 from the liquid supply unit (ink cartridge 11C). Therefore, when, for example, the ink cartridge 11C is replaced with a new one, the liquid is allowed to flow into the ink supply path 16 within a relatively short time.

In another preferred embodiment of the present invention, first, the cap 19 is attached to the nozzles 15*b* of the ink head 15. Next, the presser of the supply pump 13 is put into the pressing state by the controller 18. The motor is driven by the controller 18 in this state to actuate the suction pump 20. After the suction pump 20 is actuated for a certain time duration, the presser of the supply pump 13 is put into the releasing state by the controller 18. When the suction pump 20 is actuated while the presser is in the pressing state in this manner, a large pressure difference is caused between the pressure control valve 12 and the suction pump 20. Therefore, when the presser is put into the releasing state after this, the liquid rushes toward the suction pump 20. Thus, the liquid is allowed to flow into the ink supply path 16 in a preferred manner while air bubbles are prevented from being left in the ink supply path 16.

Figure 8:
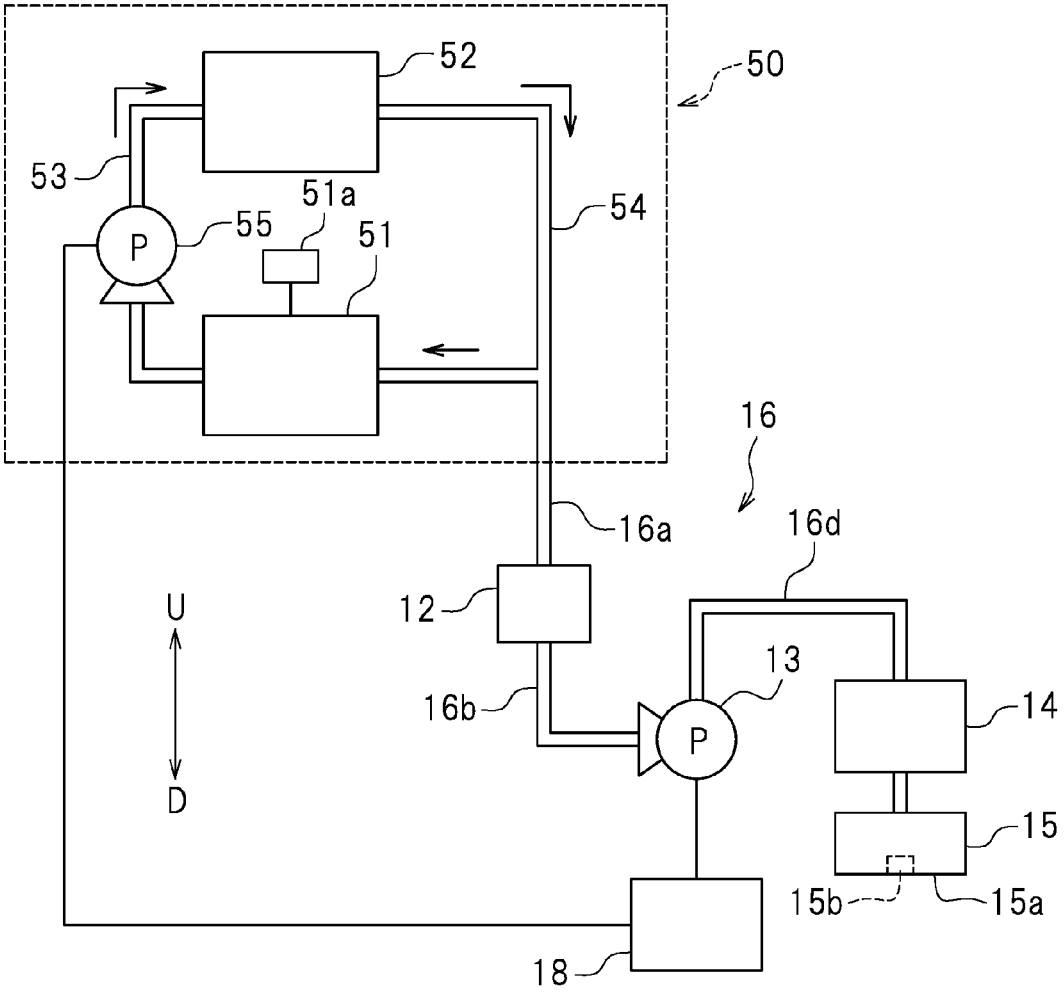
FIG. 8 is a block diagram showing a structure in which ink is supplied from an ink cartridge to an ink head in preferred embodiment 3 of the present invention.

Now, a printer according to preferred embodiment 3 of the present invention will be described. FIG. 8 is a block diagram showing a structure in which the ink is supplied from an ink supply source 50 to the ink head 15 in preferred embodiment 3. In preferred embodiment 3, the ink supply source 50 includes a circulator. The structure of the ink supply system is substantially the same as that of preferred embodiment 1 described above except for the ink supply source 50. The circulator stirs the ink stored in the ink supply source 50. The circulator is especially effective for ink of a coloring material that is easily precipitated (e.g., white ink). Mere provision of the circulator in the ink supply source 50 prevents the coloring material from being separated or precipitated, and thus maintains the ink at a uniform or substantially uniform quality.

As shown in FIG. 8, the ink supply source 50 includes a first ink tank 51, a second ink tank 52, two ink paths 53 and 54, and a circulation pump 55. The first ink tank 51 and the second ink tank 52 store ink of the same color. The two ink tanks 51 and 52 may be the same as, or different from, each other in the container shape or the capacity. In an example, the first ink tank 51 is a common ink cartridge whereas the second ink tank 52 is a large capacity ink cartridge. The capacity of the second ink tank 52 is larger than the capacity of the first ink tank 51. The positional arrangement of the two ink tanks 51 and 52 in the height direction may be arbitrarily determined. For example, the first ink tank 51 may be located above the second ink tank 52, or the second ink tank 52 may be located above the first ink tank 51. Alternatively, the two ink tanks 51 and 52 may be located at the same height.

The two ink paths 53 and 54 are in communication with the first ink tank 51 and the second ink tank 52. At least one of the two ink paths 53 and 54 is provided with a circulation pump 55. In this preferred embodiment, the ink path 53 is provided with the circulation pump 55. There is no specific limitation on the type of the circulation pump 55. The circulation pump 55 is, for example, a diaphragm pump. The circulation pump 55 is provided with a one-way valve when necessary. The one-way valve permits a flow of the ink in one direction and inhibits a flow of the ink in the opposite direction. The circulation pump 55 is coupled with a motor (not shown). The motor is connected with the controller 18, and is controlled by the controller 18.

The ink is circulated as follows. The motor is driven by the controller 18 to actuate the circulation pump 55. Then, the ink flows in the ink path 53 from the first ink tank 51 toward the second ink tank 52. The ink flows in the ink path 54 from the second ink tank 52 toward the first ink tank 51.

In FIG. 8, the arrows represent the flow of the ink during the ink circulation. The ink is circulated between the first ink tank 51 and the second ink tank 52 in this manner. For example, the ink may be kept circulated between the first ink tank 51 and the second ink tank 52 while a portion of the ink may be transmitted to the ink supply path 16. Therefore, a solid content in the liquid (ink) may be prevented from being separated or precipitated more certainly.

By contrast, during the printing, the ink is transmitted from the first ink tank 51 or the second ink tank 52 toward the tube portion 16*a* in accordance with the positional arrangement of the first ink tank 51 and the second ink tank 52, the remaining amount of the ink, and the like. The flow of the ink from the tube portion 16*a* to the ink head 15 is substantially the same as in preferred embodiment 1. The pressure fluctuation caused by the circulation pump 55 is absorbed by the pressure control valve 12. With such an arrangement, a portion of the ink supply path 16 that is downstream to the pressure control valve 12 is not influenced by the ink circulation. Therefore, the ink does not leak from the nozzles 15*b* of the ink head 15. For this reason, it is not necessary to provide a valve in the ink supply source 50 (e.g., in a portion communicating the ink path 54 and the tube portion 16*a* to each other).

In a preferred embodiment of the present invention, the first ink tank 51 is provided with an ink remaining amount sensor 51*a*. The ink remaining amount sensor 51*a* may have a conventionally known structure. The ink remaining amount sensor 51*a* is connected with the controller 18. Information on the remaining amount of the ink is transmitted to the controller 18. The controller 18 causes a display unit (not shown) of the printer main body 2 to display the remaining amount of the ink in the ink supply source 50, namely, in the two ink tanks 51 and 52. When, for example, the ink supply source 50 becomes empty, the controller 18 turns on an ink end lamp. The user may check the remaining amount of the ink in the ink supply source 50 by the display on the printer main body 2.

Figure 9:
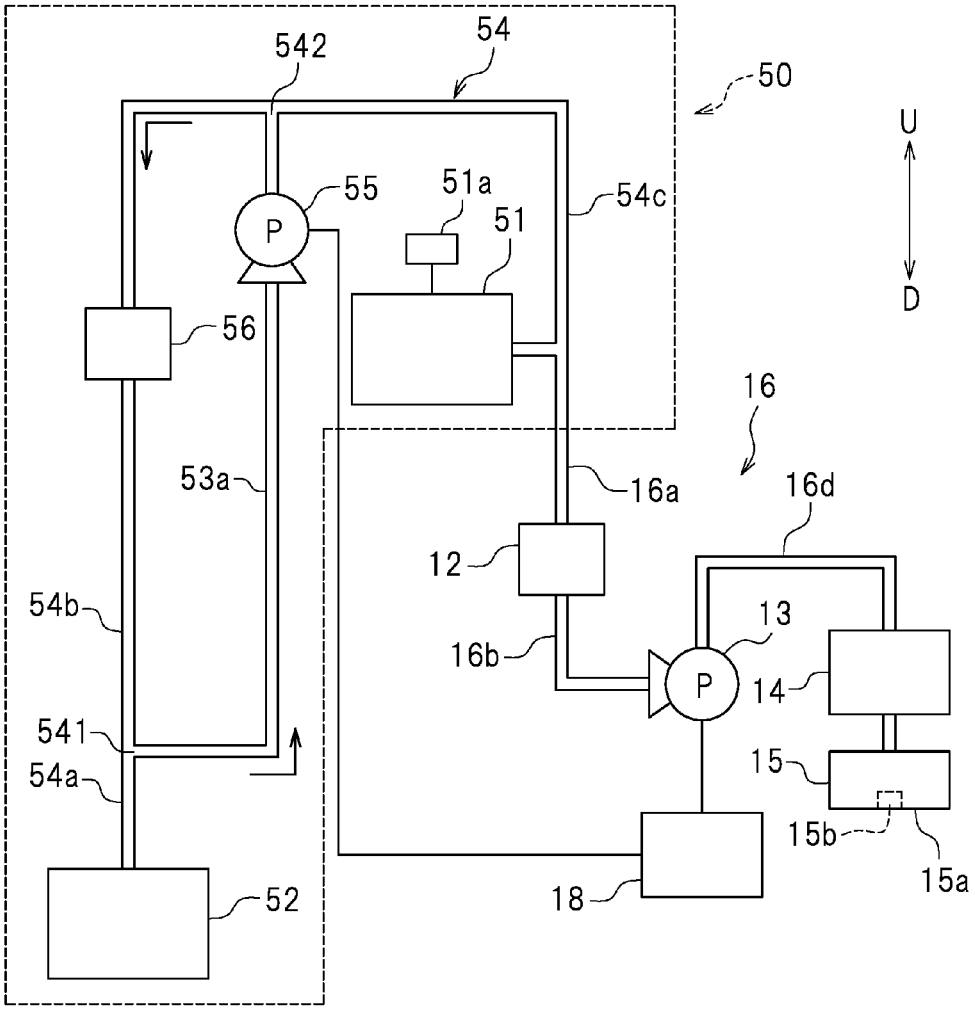
FIG. 9 is a block diagram showing a structure in which ink is supplied from an ink cartridge to an ink head in preferred embodiment 4 of the present invention.

Now, a printer according to preferred embodiment 4 of the present invention will be described. FIG. 9 is a block diagram showing a structure in which the ink is supplied from the ink supply source 50 to the ink head 15 in preferred embodiment 4. In preferred embodiment 4, the ink supply source 50 includes a circulator different from the circulator in preferred embodiment 3.

As shown in FIG. 9, the ink supply source 50 includes the first ink tank 51, the second ink tank 52, the ink paths 53*a* and 54, the circulation pump 55, and a differential pressure valve 56. Elements that are the same as those in preferred embodiment 3 will not be described in detail. The first ink tank 51 is located above the pressure control valve 12. The second ink tank 52 is located below the lower surface 15*a* of the ink head 15. Both of the ends of the ink path 53*a* are in communication with the ink path 54. Among two portions of the ink path 54 at which the ink path 54 communicates with the ink path 53*a*, the portion closer to the second ink tank 52 is a first communication portion 541, and the portion farther from the second ink tank 52 is a second communication portion 542. The ink path 54 includes ink path portions 54*a*, 54*b* and 54*c*. The ink path portion 54*a* communicates the second ink tank 52 and the first communication portion 541 to each other. The ink path portion 54*b* communicates the first communication portion 541 and the second communication portion 542 to each other. The ink path portion 54*c* communicates the second communication portion 542 and the tube portion 16*a* to each other.

In this preferred embodiment, the ink path portion 53*a* is provided with the circulation pump 55. The ink path portion 54*b* is provided with the differential pressure valve 56. In the case where there is a difference between the pressure in the flow upstream to the differential pressure valve 56 and the flow downstream to the differential pressure valve 56, a valve body of the differential pressure valve 56 is opened to release the flow path. With this structure, the pressure in the flow upstream to the differential pressure valve 56 and the pressure in the flow downstream to the differential pressure valve 56 are maintained to be equal to each other or to be different by a value within a prescribed range. There is no specific limitation on the structure of the differential pressure valve 56. For example, the valve body is opened or closed by use of a spring force of an elastic body (e.g., spring) engaged with the valve body.

The ink is circulated as follows. The motor is driven by the controller 18 to actuate the circulation pump 55. Then, the ink injected from the circulation pump 55 passes the second communication portion 542 and the ink path portion 54*b* to reach the differential pressure valve 56. The differential pressure valve 56 is configured such that the valve body thereof is opened when the pressure difference between the flow in the ink path portion 54*b* upstream thereto and the flow in the ink path portion 54*b* downstream thereto reaches a predetermined level. When the valve body of the differential pressure valve 56 is opened, the ink flows toward the first communication portion 541. This decreases the pressure difference between the flow in the ink path portion 54*b* upstream to the differential pressure valve 56 and the flow in the ink path portion 54*b* downstream to the differential pressure valve 56. When the pressure of the flow in the ink path portion 54*b* upstream to the differential pressure valve 56 becomes equal or substantially equal to the pressure of the flow in the ink path portion 54*b* downstream to the differential pressure valve 56, the valve body of the differential pressure valve 56 is closed. The ink that has passed the differential pressure valve 56 passes the ink path 53*a* to return to the circulation pump 55. In FIG. 9, the arrows represent the flow of the ink during the ink circulation. The ink is circulated between the ink path 53*a* and the ink path portion 54*b* in this manner. By contrast, during printing, the ink flows from the first ink tank 51 or the second ink tank 52 to the ink head 15 like in preferred embodiment 3. When a portion of the ink in the ink path 53*a* and the ink path portion 54*b* is supplied toward the ink head 15, the ink is supplemented from the second ink tank 52 to the ink path 53*a* and the ink path portion 54*b*.

With the structure of preferred embodiment 4, the second ink tank 52 is allowed to be located below the lower surface 15*a* of the ink head 15. Such a structure is especially preferred in the case where, for example, the second ink tank 52 is large and/or of a large capacity. This will be described more specifically. The second ink head 52 is usually located above the lower surface 15*a* of the ink head 15 (see preferred embodiment 3, FIG. 8, etc.) so that the ink easily moves to the ink head 15 by the self-weight thereof. However, in the case where the second ink tank 52 is large and/or of a large capacity, it is difficult to move the second ink tank 52 upward regarding the direction of gravity. Therefore, it imposes a significant load on the user to raise the second ink tank 52 upward regarding the direction of gravity for, for example, replacing the second ink tank 52 with a new one. In this preferred embodiment, the second ink tank 52 is allowed to be located below the lower surface 15*a* of the ink head 15 (e.g., located on the ground). Namely, it is not necessary to raise the second ink tank 52 upward. This significantly alleviates the load on the user caused by the replacement of the second ink tank 52.

Figure 10:
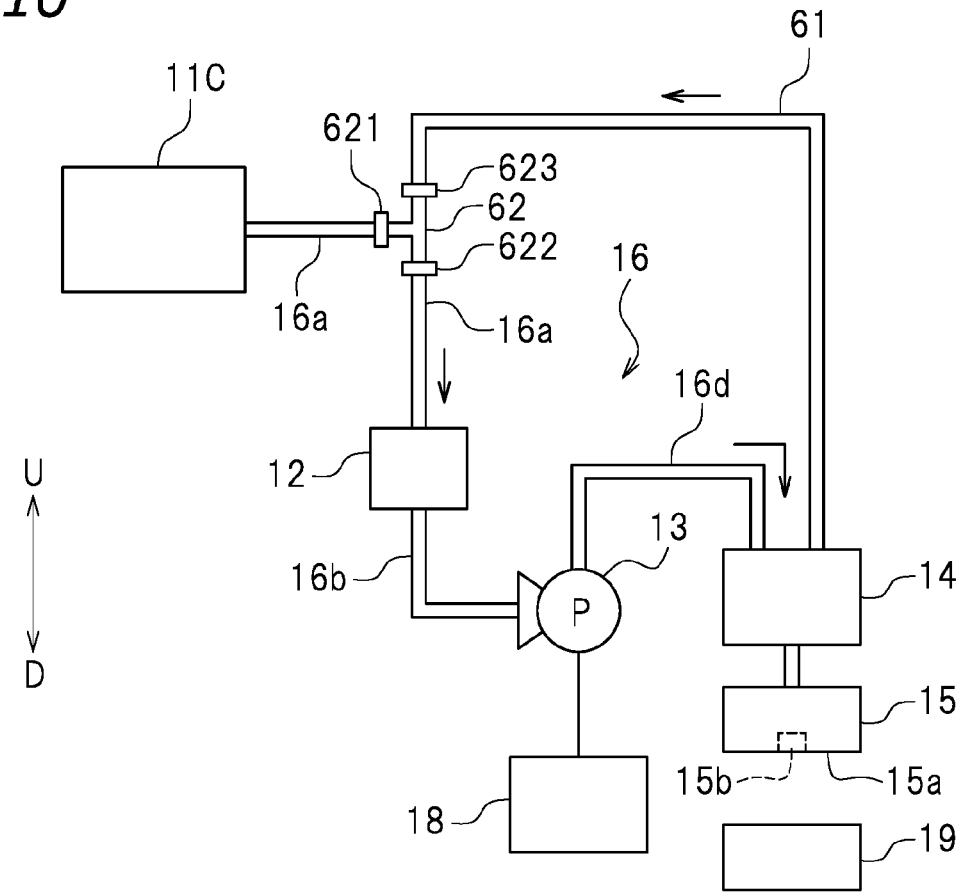
FIG. 10 is a block diagram showing a structure in which ink is supplied from an ink cartridge to an ink head in preferred embodiment 5 of the present invention.

Now, a printer in preferred embodiment 5 will be described. FIG. 10 is a block diagram showing a structure in which the ink is supplied from the ink cartridge 11C to the ink head 15 in preferred embodiments. In preferred embodiments, the ink supply system includes an ink recovery path 61. The structure of the ink supply system is substantially the same as that of preferred embodiment 1 described above except for the ink recovery path 61.

As shown in FIG. 10, the ink recovery path 61 is a flow path usable to return the ink from the damper 14 to the tube 16. An end of the ink recovery path 61 is connected with the damper 14. The other end of the ink recovery path 61 is connected with a portion of the ink supply path 16 that is between the ink cartridge 11C and the pressure control valve 12, namely, with the tube portion 16*a*. The ink recovery path 61 is formed of, for example, a material substantially the same as that of the ink supply path 16.

At a portion at which the ink recovery path 61 and the tube portion 16*a* are in communication with each other, a three-way valve 62 is located. The three-way valve 62 includes a first connection opening 621 communicable with the ink cartridge 11C via the tube portion 16*a* of the ink supply path 16, a second connection opening 622 communicable with the pressure control valve 12 via the tube portion 16*a* of the ink supply path 16, and a third connection opening 623 communicable with the ink recovery path 61. There is no specific limitation on the type of the three-way valve 62. The three-way valve 62 is, for example, an electromagnetic valve. The three-way valve 62 is connected with the controller 18. The three connection openings 621, 622 and 623 are switched into a communication state or non-communication state by the controller 18.

The ink is circulated as follows. First, the cap 19 is attached to the lower surface 15*a* of the ink injection head 15 (surface on the side of the nozzles 15*b*). Next, the controller 18 opens the second connection opening 622 and the third connection opening 623 of the three-way valve 62 and closes the first connection opening 621. Namely, the three-way valve 62 switches the connection openings 621, 622 and 623 to realize a state where the second connection opening 622 and the third connection opening 623 are in communication with each other. In this state, the supply pump 13 is actuated. Then, the ink flows in the ink recovery path 61 from the damper 14 toward the three-way valve 62. The ink that has passed the ink recovery path 61 passes the ink supply path 16 to flow toward the damper 14. In FIG. 10, the arrows represent the direction of flow of the ink during the ink circulation. The ink is circulated in the ink supply system in this manner. Thus, the ink is maintained at a uniform quality. As a result, a solid content in the ink (e.g., coloring material) is prevented from being separated or precipitated more certainly. In addition, the amount of the ink that is wasted is reduced.

In the meantime, during the printing, the controller 18 opens the first connection opening 621 and the second connection opening 622 of the three-way valve 62 and closes the third connection opening 623. Namely, the three-way valve 62 switches the connection openings 621, 622 and 623 to realize a state where the first connection opening 621 and the second connection opening 622 are in communication with each other. Then, the ink is transmitted from the ink cartridge 11C toward the tube portion 16*a*. The flow of the ink from the tube portion 16*a* to the ink head 15 is substantially the same as in preferred embodiment 1.

Figure 11:
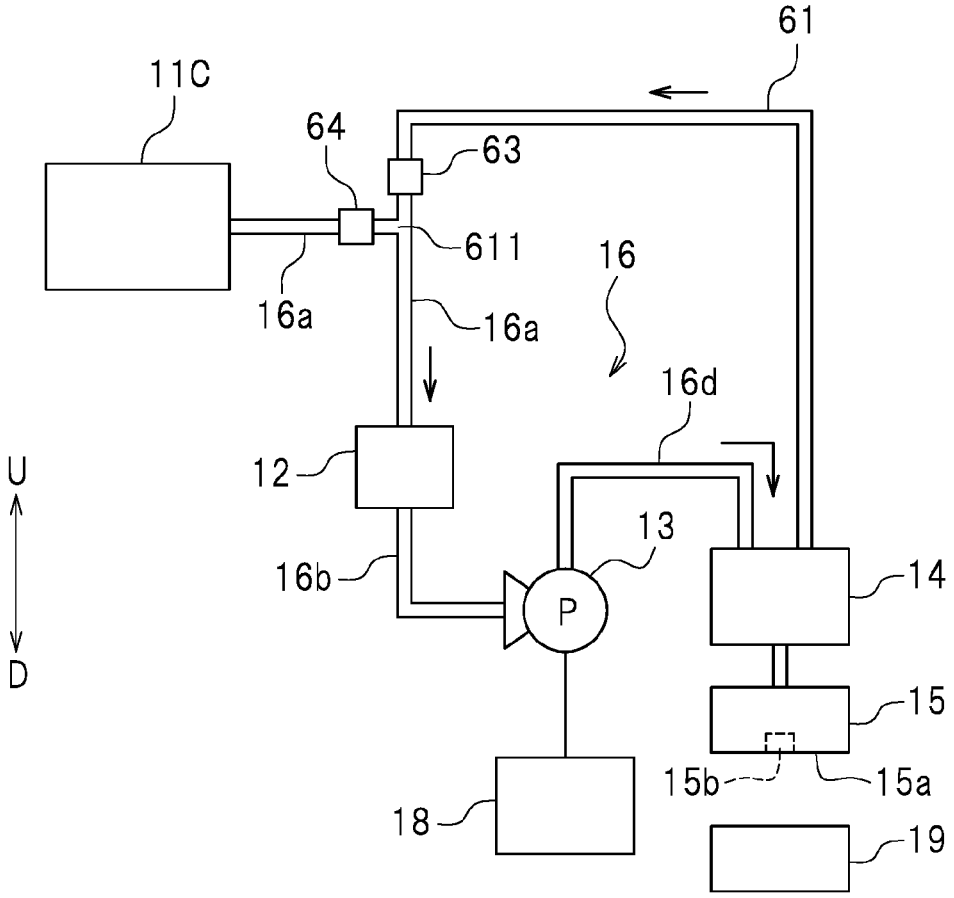
FIG. 11 is a block diagram showing a structure in which ink is supplied from an ink cartridge to an ink head in a modification of preferred embodiment 5 of the present invention.

FIG. 11 is a block diagram showing a structure in which ink is supplied from an ink cartridge to an ink head in a modification of preferred embodiment 5. In a modification shown in FIG. 11, at a communication portion 611 at which the ink recovery path 61 and the tube portion 16*a* are in communication with each other, two choke valves 63 and 64 are provided instead of the three-way valve 62. The choke valves 63 and 64 are respectively examples of first valve and second valve. The choke valve 63 is provided on the ink recovery path 61. The choke valve 63 opens or closes the portion between the damper 14 and the communication portion 611. The choke valve 64 is provided on the tube portion 16*a*. The choke valve 64 opens or closes the portion between the ink cartridge 11C and the communication portion 611. The choke valves 63 and 64 are connected with the controller 18. The choke valves 63 and 64 are controlled to be opened or closed by the controller 18.

The ink is circulated as follows. First, the cap 19 is attached to the lower surface 15*a* of the ink injection head 15 (surface on the side of the nozzles 15*b*). Next, the controller 18 opens the choke valve 63 and closes the choke valve 64. In this state, the supply pump 13 is actuated. Then, the ink flows in the ink recovery path 61 from the damper 14 toward the choke valve 63. The ink that has passed the ink recovery path 61 passes the ink supply path 16 to flow toward the damper 14. In FIG. 11, the arrows represent the direction of flow of the ink during the ink circulation. The ink is circulated in the ink supply system in this manner like in FIG. 10.

In the meantime, during the printing, the controller 18 opens the choke valve 64 and closes the choke valve 63. Then, the ink is transmitted from the ink cartridge 11C toward the tube portion 16*a*. The flow of the ink from the tube portion 16*a* to the ink head 15 is substantially the same as in preferred embodiment 1.

Figure 12:
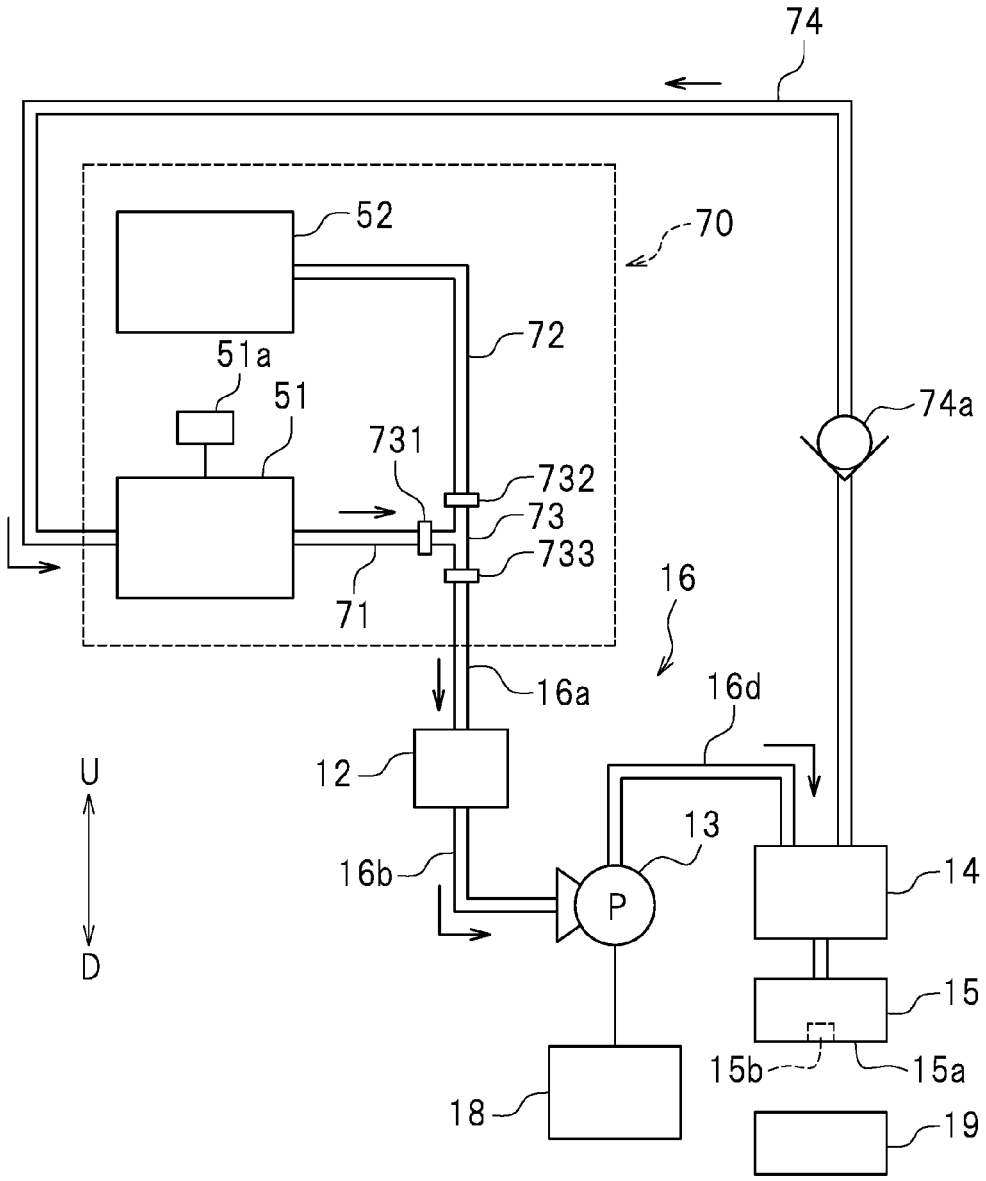
FIG. 12 is a block diagram showing a structure in which ink is supplied from an ink cartridge to an ink head in preferred embodiment 6 of the present invention.

Now, a printer according to preferred embodiment 6 of the present invention will be described. FIG. 12 is a block diagram showing a structure in which the ink is supplied from an ink supply source 70 to the ink head 15 in preferred embodiment 6. In preferred embodiment 6, the ink supply source 70 includes a plurality of ink tanks. The ink supply system includes an ink recovery path 74. The structure of the ink supply system is substantially the same as that of preferred embodiment 1 described above except for these elements.

As shown in FIG. 12, the ink supply source 70 includes the first ink tank 51, the second ink tank 52, a first ink path 71, a second ink path 72, and a three-way valve 73.

The two ink tanks 51 and 52 and the ink remaining amount sensor 51*a* are substantially the same as those in preferred embodiment 3. The first ink path 71 is in communication with the first ink tank 51. The second ink path 72 is in communication with the second ink tank 52. The three-way valve 73 is located at a portion at which the first ink path 71, the second ink path 72 and the tube portion 16*a* of the ink supply path 16 are in communication with each other. The three-way valve 73 includes a first connection opening 731 communicable with the first ink path 71, a second connection opening 732 communicable with the second ink path 72, and a third connection opening 733 communicable with the tube portion 16*a* of the ink supply path 16. There is no specific limitation on the type of the three-way valve 73. The three-way valve 73 is, for example, an electromagnetic valve. The three-way valve 73 is connected with the controller 18. The three connection openings 731, 732 and 733 are switched into a communication state or non-communication state by the controller 18.

The ink recovery path 74 is a flow path usable to return the ink from the damper 14 to the first ink tank 51. An end of the ink recovery path 74 is connected with the first ink tank 51. The other end of the ink recovery path 74 is connected with the damper 14. The ink recovery path 74 is formed of, for example, a material substantially the same as that of the ink supply path 16.

The ink is circulated as follows. First, the cap 19 is attached to the lower surface 15*a* of the ink injection head 15 (surface on the side of the nozzles 15*b*). Next, the controller 18 opens the first connection opening 731 and the third connection opening 733 of the three-way valve 73 and closes the second connection opening 732. The three-way valve 73 is switched to a state where the first connection opening 731 and the third connection opening 733 are in communication with each other. In this state, the supply pump 13 is actuated. Then, the ink flows in the ink recovery path 74 from the damper 14 toward the first ink tank 51. The ink that has passed the ink recovery path 74 passes the ink supply path 16 to flow toward the damper 14. In FIG. 12, the arrows represent the direction of flow of the ink during the ink circulation. The ink is circulated in the ink supply system in this manner.

In the meantime, during the printing, the controller 18 opens the second connection opening 732 and the third connection opening 733 of the three-way valve 73 and closes the first connection opening 731. The three-way valve 73 switched to a state where the second connection opening 732 and the third connection opening 733 are in communication with each other. In this state, the supply pump 13 is actuated. Then, the ink is transmitted from the second ink tank 52 toward the tube portion 16*a*. The flow of the ink from the tube portion 16*a* to the ink head 15 is substantially the same as in preferred embodiment 1.

In a preferred embodiment of the present invention, the ink recovery path 74 is provided with a one-way valve 74*a*. The one-way valve 74*a* permits a flow of the ink from the damper 14 toward the first ink tank 51 and inhibits a flow of the ink in the opposite direction (direction from the first ink tank 51 toward the damper 14). According to the studies made by the present invention inventors, in the case where the first ink tank 51 is located at a certain position, the hydraulic head difference between the first ink tank 51 and the ink head 15 may become excessively large, resulting in the ink flowing in the opposite direction from the first ink tank 51 toward the damper 14. In the case where, for example, the first ink tank 51 is located above the nozzles 15*b* of the ink head 15, the pressure of the first ink tank 51 may be applied to the nozzles 15*b* via the ink recovery path 74. By contrast, the above-described structure properly alleviates the hydraulic head applied to the ink head 15. Therefore, the ink is circulated in the ink supply system stably.

In a preferred embodiment in which the one-way valve 74*a* is provided, during the ink circulation, the ink may be circulated in the ink supply system in the same manner as in the above-described case where no one-way valve is provided. In the preferred embodiment in which the one-way valve 74*a* is provided, during the printing, the ink supply system is controllable in the same manner as in the above-described case where no one-way valve is provided. All the connection openings 731, 732 and 733 of the three-way valve 73 may be opened by the controller 18. In the case where the one-way valve 74*a* is provided between the first ink tank 51 and the damper 14, even if all the connection openings 731, 732 and 733 of the three-way valve 73 are opened, the ink does not flow from the first ink tank 51 to the damper 14. Therefore, the supply pump 13 is actuated in the state where all the connection openings 731, 732 and 733 of the three-way valve 73 are opened. Then, like in the case where there is no one-way valve, the ink is transmitted from the second ink tank 52 to the tube portion 16*a*. When the first ink tank 51 is not full, the ink is also transmitted from the second ink tank 52 to the first ink tank 51. When the second ink tank 52 becomes empty, the ink is transmitted from the first ink tank 51 toward the tube portion 16*a*. The first ink tank 51 is provided with the ink remaining amount sensor 51*a*. Therefore, the user can check whether the second ink tank 52 is empty or not, the remaining amount of the ink in the first ink tank 51, and whether the printer 10 is in an ink end state or not.

Figure 13:
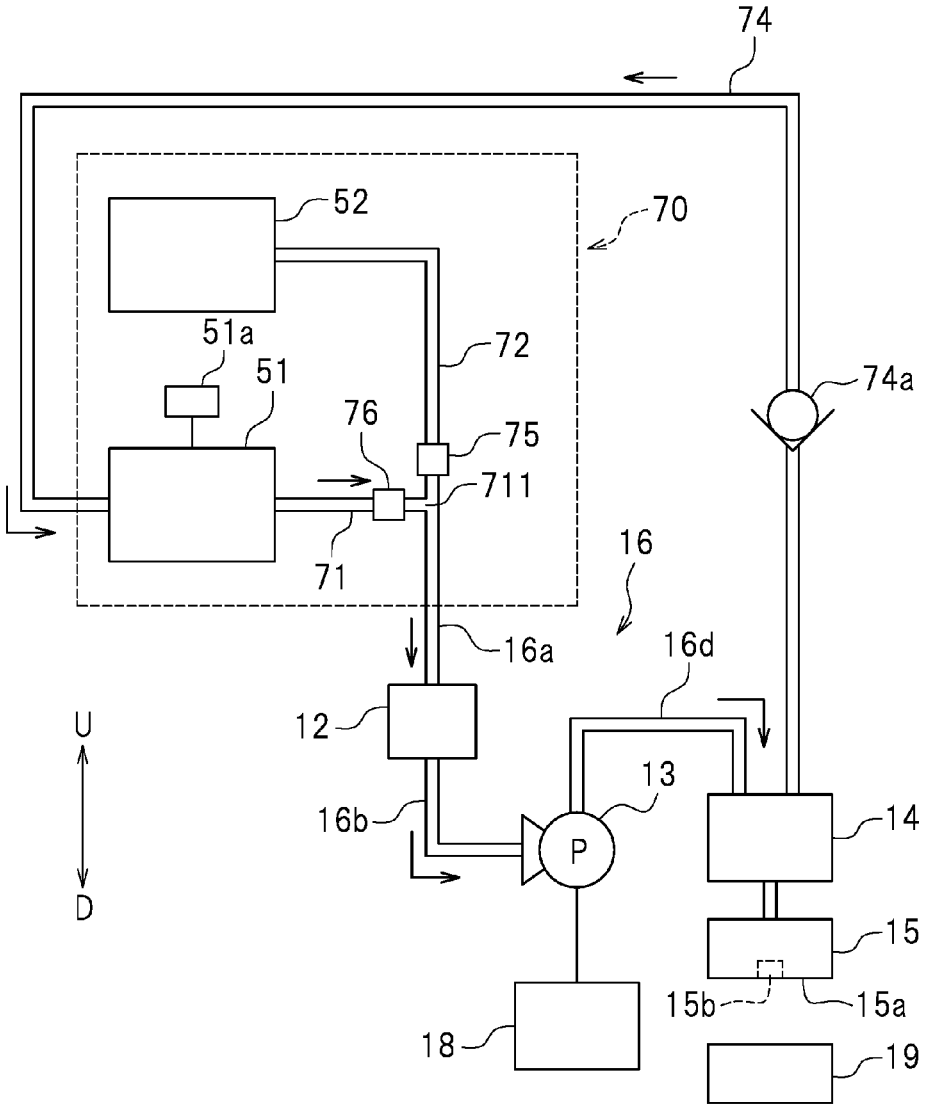
FIG. 13 is a block diagram showing a structure in which ink is supplied from an ink cartridge to an ink head in a modification of preferred embodiment 6 of the present invention.

FIG. 13 is a block diagram showing a structure in which ink is supplied from an ink cartridge to an ink head in a modification of preferred embodiment 6. In a modification shown in FIG. 13, at a communication portion 711 at which the first ink path 71 and the tube portion 16*a* are in communication with each other, two choke valves 75 and 76 are provided instead of the three-way valve 73. The choke valves 75 and 76 are respectively examples of first valve and second valve. The choke valve 75 is provided on the second ink path 72. The choke valve 75 opens or closes a portion between the second ink tank 52 and the communication portion 711. The choke valve 76 is provided on the first ink path 71. The choke valve 76 opens or closes a portion between the first ink tank 51 and the communication portion 711. The choke valve 76 is opened or closed for, for example, filling the ink supply path 16 with the ink. The choke valves 75 and 76 are connected with the controller 18. The choke valves 75 and 76 are controlled to be opened or closed by the controller 18.

The ink is circulated as follows. First, the cap 19 is attached to the lower surface 15*a* of the ink injection head 15 (surface on the side of the nozzles 15*b*). Next, in the state where the ink head 15 is covered with the cap 19, the controller 18 opens the choke valve 76 and closes the choke valve 75. In this state, the supply pump 13 is actuated. Then, the ink flows in the ink recovery path 74 from the damper 14 toward the choke valve 75. The ink that has passed the ink recovery path 74 passes the ink supply path 16 to flow toward the damper 14. In FIG. 13, the arrows represent the direction of flow of the ink during the ink circulation. The ink is circulated in the ink supply system in this manner like in FIG. 12.

In the meantime, during the printing, the controller 18 opens the choke valves 75 and 76 in the state where the nozzles 15*b* of the ink head 15 are opened. Then, the ink is transmitted from the second ink tank 52, which is located at a position higher than that of the first ink tank 51, toward the tube portion 16*a*. The flow of the ink from the tube portion 16*a* to the ink head 15 is substantially the same as in preferred embodiment 1. The ink in the ink head 15 is injected from the nozzles 15*b*. When the second ink tank 52 becomes empty, the ink is transmitted from the first ink tank 51 toward the tube portion 16*a*. The first ink tank 51 is provided with the ink remaining amount sensor 51*a*. Therefore, when the first ink tank 51 becomes empty, an ink end state is detected.

Preferred embodiments of the present invention are described above. The above-described preferred embodiments are merely examples, and the present invention may be carried out in any of various other preferred embodiments. For example, in each of the above-described preferred embodiments, the ink supply system is included in the inkjet recording device (specifically, the inkjet printer 10).

The ink supply system is not limited to being included in an inkjet recording device. The ink supply system is usable in various production devices adopting an inkjet system, and measuring devices such as a micropipette and the like. The inkjet recording device may be any device capable of recording an image. In each of the above-described preferred embodiments, the liquid stored in the liquid supply source (specifically, the ink cartridge 11C, etc.) is ink. The liquid is not limited to ink. The liquid may be, for example, a washing liquid or the like usable for maintenance of the recording device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid supply system, comprising:

a liquid supply source including a first liquid tank storing a liquid and a second liquid tank storing the liquid;

an injection head including a nozzle through which the liquid is injected;

a damper that is connected to the injection head and includes a storage chamber storing the liquid;

a liquid supply path including an end in communication with the liquid supply source and another end connected to the damper;

a liquid supply pump that is located between the liquid supply source and the damper;

a pressure control valve between the liquid supply source and the liquid supply pump; and a controller configured or programmed to control the liquid supply pump to be in at least one of an ON condition and an OFF condition; wherein the first liquid tank and the second liquid tank are different from each other in at least one of position, volume and weight; and the pressure control valve includes a valve member that opens or doses according to a flexible deformation of a pressure sensitive film.

2. The liquid supply system according to claim 1, wherein the second liquid tank is located below the nozzle of the injection head with respect to a direction of gravity.

3. The liquid supply system according to claim 2, wherein the first liquid tank is located above the nozzle of the injection head with respect to the direction of gravity.

4. The liquid supply system according to claim 1, wherein the second liquid tank is located on the ground.

5. The liquid supply system according to claim 1, wherein the second liquid tank is larger than the first liquid tank.

6. The liquid supply system according to claim 1, wherein the second liquid tank is heavier than the first liquid tank.

7. The liquid supply system according to claim 1, wherein a capacity of the second liquid tank is at least more than twice a capacity of the first liquid tank.

8. The liquid supply system according to claim 1, wherein a distance between the second liquid tank and the nozzle of the injection head is greater than a distance between the first liquid tank and the nozzle of the injection head.

9. The liquid supply system according to claim 1, further comprising:

a liquid circulation path that circulates the liquid stored in the second liquid tank;

a liquid circulation pump provided on the liquid circulation path.

10. The liquid supply system according to claim 9, further comprising:

a differential pressure valve provided on the liquid circulation path.

11. The liquid supply system according to claim 1, wherein:

the pressure control valve closes the liquid supply path while the liquid supply pump is stopped.

* * * * *